US008752929B2

(12) United States Patent
Arakane et al.

(10) Patent No.: US 8,752,929 B2
(45) Date of Patent: Jun. 17, 2014

(54) IMAGE RECORDING APPARATUS

(71) Applicant: Brother Kogyo Kabushiki Kaisha, Nagoya (JP)

(72) Inventors: Satoru Arakane, Kasugai (JP); Yuki Matsui, Kiyosu (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,703

(22) Filed: Mar. 28, 2013

(65) Prior Publication Data

US 2013/0278664 A1 Oct. 24, 2013

(30) Foreign Application Priority Data

Apr. 24, 2012 (JP) ..... 2012-098708

(51) Int. Cl.
*B41J 29/38* (2006.01)

(52) U.S. Cl.
USPC ..... 347/16

(58) Field of Classification Search
USPC ..... 347/4, 16, 105
See application file for complete search history.

(56) References Cited

U.S. PATENT DOCUMENTS

| | | | | |
|---|---|---|---|---|
| 8,132,883 | B2 * | 3/2012 | Niihara et al. | 347/16 |
| 8,573,730 | B2 * | 11/2013 | Mitsuhashi et al. | 347/16 |
| 8,628,161 | B2 * | 1/2014 | Houjou | 347/16 |
| 2011/0069102 | A1 | 3/2011 | Horade et al. | |

FOREIGN PATENT DOCUMENTS

| | | | |
|---|---|---|---|
| JP | H10-329974 | A | 12/1998 |
| JP | 2011-067983 | A | 4/2011 |
| JP | 2012-000898 | A | 1/2012 |

* cited by examiner

*Primary Examiner* — Lamson Nguyen
(74) *Attorney, Agent, or Firm* — Merchant & Gould P.C.

(57) ABSTRACT

An image recording apparatus, including: a supply tray; a supply roller; a manual tray; a recording device; a motor; a supply driving power transmitter which transmits a reverse driving power of the motor to the supply roller; a conveyance driving power transmitter; a switcher switchable between a first state in which a driving power of the motor is transmitted to the supply driving power transmitter and a second state in which the driving power is not transmitted to the supply driving power transmitter; and a controller configured to, when an image is to be recorded on a sheet placed on the manual tray and when the switcher is in the first state, switches the switcher to the second state and rotates the motor reversely to rotate a conveyor roller in a second rotational direction reverse to a first rotational direction for conveying a sheet in a conveying direction.

13 Claims, 12 Drawing Sheets

FIG.5

| SWITCH GEAR 51 | FIRST POWER TRANSMISSION POSITION | | SECOND POWER TRANSMISSION POSITION | | THIRD POWER TRANSMISSION POSITION | |
|---|---|---|---|---|---|---|
| CONVEYOR MOTOR 71 | FORWARD ROTATION | REVERSE ROTATION | FORWARD ROTATION | REVERSE ROTATION | FORWARD ROTATION | REVERSE ROTATION |
| FIRST CONVEYOR ROLLER 60 | FIRST DIRECTION (CONVEYANCE POWER TRANSMITTER 23) | DIRECTION OPPOSITE TO FIRST DIRECTION (CONVEYANCE POWER TRANSMITTER 23) | FIRST DIRECTION (CONVEYANCE POWER TRANSMITTER 23) | DIRECTION OPPOSITE TO FIRST DIRECTION (CONVEYANCE POWER TRANSMITTER 23) | FIRST DIRECTION (CONVEYANCE POWER TRANSMITTER 23) | DIRECTION OPPOSITE TO FIRST DIRECTION (CONVEYANCE POWER TRANSMITTER 23) |
| SECOND CONVEYOR ROLLER 62 | FIRST DIRECTION (FIRST POWER TRANSMITTER 26) | STOPPED | FIRST DIRECTION (FIRST POWER TRANSMITTER 26) | DIRECTION OPPOSITE TO FIRST DIRECTION (SECOND POWER TRANSMITTER 27) | FIRST DIRECTION (FIRST POWER TRANSMITTER 26) | STOPPED |
| THIRD CONVEYOR ROLLER 45 | FIRST DIRECTION (THIRD POWER TRANSMITTER 33) | STOPPED | FIRST DIRECTION (THIRD POWER TRANSMITTER 33) | DIRECTION OPPOSITE TO FIRST DIRECTION (THIRD POWER TRANSMITTER 33) | FIRST DIRECTION (THIRD POWER TRANSMITTER 33) | STOPPED |
| FOURTH CONVEYOR ROLLER 68 | STOPPED | STOPPED | SECOND DIRECTION (FOURTH POWER TRANSMITTER 28) | SECOND DIRECTION (FOURTH POWER TRANSMITTER 28) | STOPPED | STOPPED |
| SUPPLY ROLLER 25 | STOPPED | FIRST DIRECTION (SUPPLY POWER TRANSMITTER 29) | STOPPED | STOPPED | STOPPED | STOPPED |
| PUMP | STOPPED | STOPPED | STOPPED | STOPPED | STOPPED | DRIVING |

59
118
56
55
51
75
57
88
78
95
27
91
90
89
60
29
9
7
RIGHT
LEFT
REAR
FRONT

IMAGE RECORDING APPARATUS

CROSS REFERENCE TO RELATED APPLICATION

The present application claims priority from Japanese Patent Application No. 2012-098708, which was filed on Apr. 24, 2012, the disclosure of which is herein incorporated by reference in its entirety.

BACKGROUND OF THE INVENTION

1. Field of the Invention

The present invention relates to an image recording apparatus configured to record an image on a sheet placed on a manual tray.

2. Description of the Related Art

There is conventionally known an image recording apparatus with a manual tray as an image recording apparatus for recording an image on a sheet.

As the above-described image recording apparatus, for example, there is known an image recording apparatus provided with a manual tray that supports a sheet in a state in which the sheet is supported in contact with a conveyor roller provided in a conveyance path in the apparatus. When the conveyor roller is rotated forwardly in this state, the sheet is conveyed by the conveyor roller toward a recording portion.

Also, the image recording apparatus includes a supply tray at a lower portion of the apparatus. A sheet placed on the supply tray is supplied to the conveyance path by a supply roller provided on an upper side of the supply tray. The sheet supplied to the conveyance path is conveyed to the conveyor roller and then conveyed to the recording portion.

SUMMARY OF THE INVENTION

Here, there is an image recording apparatus in which a conveyor roller and a supply roller are rotated by a driving power produced by a common motor. This image recording apparatus has the following construction, for example, as the construction in which the conveyor roller and the supply roller are rotated by the common motor. When the motor rotates forwardly, the conveyor roller is rotated in a conveying rotational direction for conveying a sheet to a recording portion, and the supply roller is not rotated. On the other hand, when the motor rotates reversely, the conveyor roller is rotated in a direction for conveying the sheet backward, i.e., in a reverse conveying rotational direction that is reverse to the conveying rotational direction, and the supply roller is rotated in a supply rotational direction for supplying the sheet to the conveyance path.

In this construction, the motor is rotated reversely first, so that a leading edge of the sheet which is supplied from the supply tray to the conveyance path is brought into contact with the conveyor roller rotating in the reverse conveying rotational direction. As a result, skew of the sheet supplied by the supply roller is corrected by the conveyor roller rotating in the reverse conveying rotational direction. The motor is then rotated forwardly, so that the sheet is conveyed toward the recording portion by the conveyor roller rotating in the conveying rotational direction.

However, in a case where the above-described construction is applied to the image recording apparatus provided with the manual tray, the following problem arises. When the motor is rotated reversely in a state in which the sheet is placed on the manual tray, the sheet placed on the manual tray is brought into contact with the conveyor roller rotating in the reverse conveying rotational direction. This operation corrects skew of the sheet placed on the manual tray. Meanwhile, when the motor is rotated reversely, the sheet placed on the supply tray is supplied to the conveyance path by the supply roller.

As a result, the sheet placed on the supply tray is located in the conveyance path. That is, the sheet is located downstream in a supply direction from a position assumed by the image recording apparatus, i.e., an ideal position where the sheet should be located. Thus, in a case where the sheet placed on the supply tray is supplied after the image recording on the sheet placed on the manual tray, there is a risk in which the image recording apparatus determines a malfunction in the conveyance of the sheet.

This invention has been developed to provide an image recording apparatus capable of preventing a sheet placed on a supply tray from being supplied when skew of a sheet placed on a manual tray is corrected.

The present invention provides an image recording apparatus, comprising: a supply tray configured to support a sheet; a supply roller rotatable to supply the sheet supported by the supply tray to a conveyance path; a conveyor roller rotatable to convey, in a conveying direction, the sheet supplied by the supply roller to the conveyance path; a manual tray configured to support a sheet that is to be supplied to a manual-tray path merged with the conveyance path at a position located upstream of the conveyor roller in the conveying direction; a recording device diseposed downstream of the conveyor roller in the conveying direction and configured to record an image on the sheet; a motor rotatable to produce a driving power, wherein the motor is configured to produce a forward rotational (hiving power when the motor rotates forwardly and produce a reverse rotational driving power when the motor rotates reversely; a supply driving power transmitter configured not to transmit the forward rotational driving power to the supply roller and configured to transmit the reverse rotational driving power to the supply roller; a conveyance driving power transmitter configured to transmit the forward rotational driving power to the conveyor roller to cause the conveyor roller to rotate in a first rotational direction to convey the sheet in the conveying direction, the conveyance driving power transmitter being configured to transmit the reverse rotational driving power to the conveyor roller to cause the conveyor roller to rotate in a second rotational direction that is reverse to the first rotational direction; a switcher configured to switch between a first power transmission state in which the driving power is transmitted from the motor to the supply driving power transmitter and a second power transmission state in which the driving power is not transmitted from the motor to the supply driving power transmitter; and a controller configured to, when an image is to be recorded on the sheet supported by the manual tray by the recording device and when the switcher is in the first power transmission state, execute a switching control for switching the switcher from the first power transmission state to the second power transmission state and thereafter execute a reverse-rotation control for causing the motor to rotate reversely to rotate the conveyor roller in the second rotational direction.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which;

FIG. 5 is a table for explaining drivings of supply rollers 25, the conveyor rollers 60, 62, 45, 68, and a pump 119 depending upon a position of a switch gear 51;

FIGS. 7A and 7B are front views in cross section each schematically illustrating a construction of a maintenance mechanism 170, wherein FIG. 7A illustrates a state in which a cap 171 is in a separated state, and FIG. 7B illustrates a state in which a cap 171 is in a capping state;

DETAILED DESCRIPTION OF THE EMBODIMENT

Figure 1:
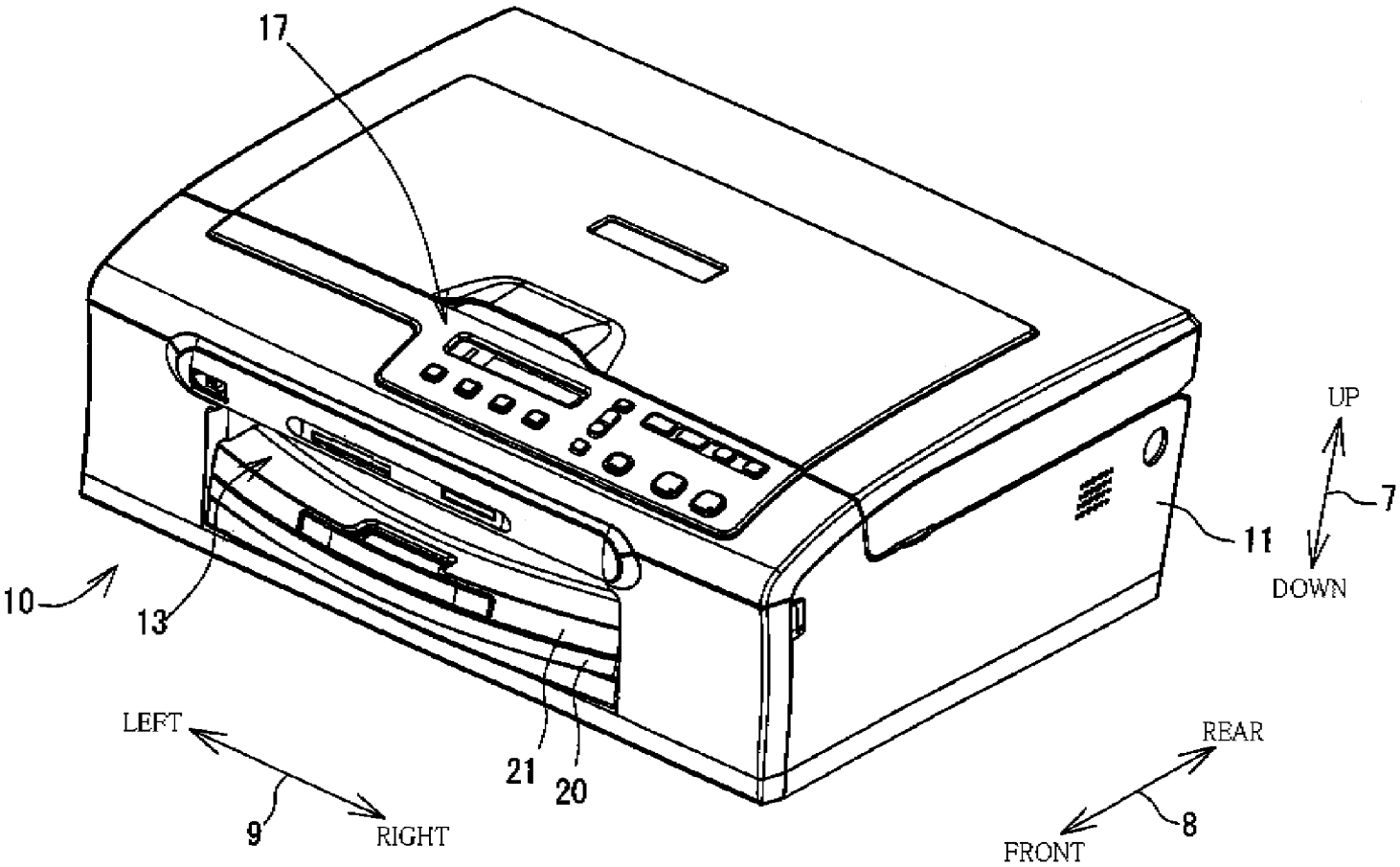
FIG. 1 is a perspective view illustrating an MFP 10.

Hereinafter, there will be described one embodiment of the present invention by reference to the drawings. It is to be understood that the following embodiment is described only by way of example, and the invention may be otherwise embodied with various modifications without departing from the scope and spirit of the invention. A multi-function peripheral (MFP) 10 is used in a state illustrated in FIG. 1. In the present embodiment, three arrows illustrated in FIG. 1 indicate up and down directions 7, front and rear directions 8, and right and left directions 9. In the following explanation, the up and down directions 7 are defined as up and down directions of the MFP 10 illustrated in FIG. 1, i.e., the MFP 10 being in a normal state. Also, the front and rear directions 8 are defined by regarding a side of the MFP 10 on which an opening 13 is formed as a front side, and the right and left directions 9 are defined in a state in which the MFP 10 is seen from the front side. It is noted that the directions illustrated in FIG. 1 are also indicated in other drawings in a similar manner. Also, in the following explanation, the term "direction" means a one-way direction which is directed from one point toward another point, and the term "directions" means opposite directions. That is, the term "directions" includes a direction directed from one point toward another point and a direction directed from said another point toward the one point.

<Overall Structure of MFP 10>

The MFP 10 is one example of an image recording apparatus as one embodiment according to the present invention. As illustrated in FIG. 1, the MFP 10 includes a printing section 11 at its lower portion. The MFP 10 has various functions such as a facsimile function and a printing function. The printing function includes a duplex image recording function for recording images on front and back faces of a recording sheet 12 (see FIG. 2). It is noted that the MFP 10 may be configured to record an image on only one face of the recording sheet 12 without having the duplex image recording function. The printing section 11 has the opening 13 in its front face. The MFP 10 includes: a supply fray 20 on which the recording sheet 12 can be placed; and an output tray 21. These trays 20, 21 can be inserted or removed through the opening 13 in the front and rear directions 8. A plurality of the recording sheets 12 can be stacked on the supply tray 20. A recording sheet 12 on which an image or images are recorded by a recording portion 24 (as one example of a recording device) which will be described below is discharged onto the output tray 21.

Figure 2:
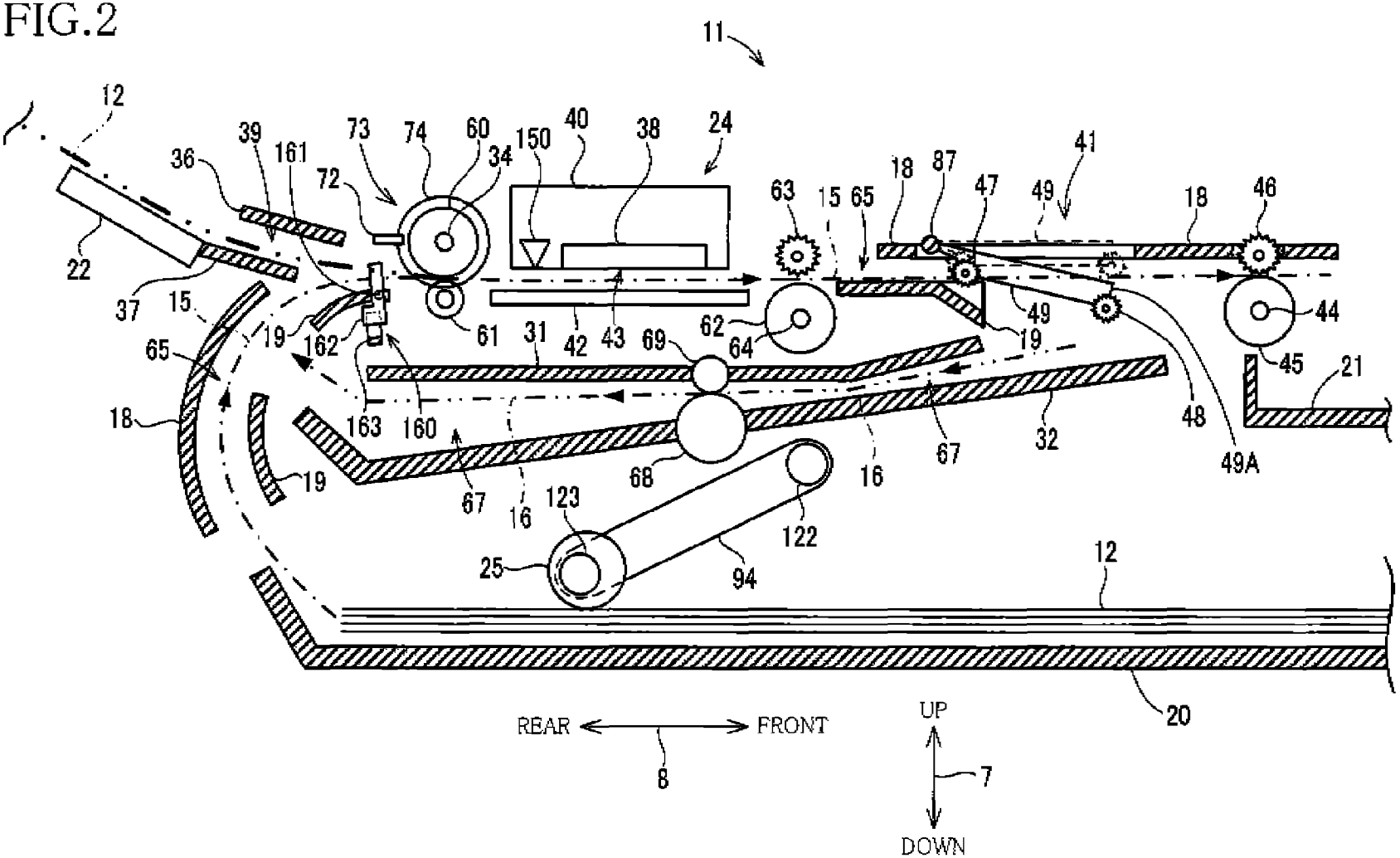
FIG. 2 is an elevational view in vertical cross section schematically illustrating an internal structure of a printing section 11.

As illustrated in FIG. 2, supply rollers 25 are provided on an upper side of the supply tray 20. The supply rollers 25 are contactable with an upper face of the recording sheet 12 placed on the supply fray 20. The supply rollers 25 are rotated by receiving a driving power from a conveyor motor 71 (as one example of a motor, see FIGS. 3 and 8) rotating in its reverse direction. As a result, the recording sheet 12 placed on the supply tray 20 is supplied to a first conveyor roller 60 which will be described below through a first conveyance path 65.

The first conveyance path 65 extends from a rear end portion of the supply tray 20. The first conveyance path 65 includes a curved portion and a straight portion. The first conveyance path 65 is defined by an outer guide member 18 and an inner guide member 19 which are opposed to each other at a predetermined distance therebetween. The recording sheet 12 placed on the supply tray 20 is conveyed through the curved portion from its lower side toward upper side so as to make a U-turn. The recording sheet 12 is then conveyed to the recording portion 24 through the straight portion. The recording portion 24 performs image recording on the recording sheet 12. After the image recording, the recording sheet 12 is conveyed through the straight portion and discharged onto the output tray 21. That is, the recording sheet 12 is conveyed in the first direction 15 (as one example of a conveying direction) indicated by one-dot chain-line arrow in FIG. 2.

<First Conveyor Roller 60, Second Conveyor Rollers 62, and Third Conveyor Rollers 45>

As illustrated in FIG. 2, a plurality of roller pairs are provided in the first conveyance path 65. Specifically, a pair of the first conveyor roller 60 and pinch rollers 61 are provided upstream of the recording portion 24 in the first direction 15. Also, a pair of a spur 63 and second conveyor rollers 62 are provided downstream of the recording portion 24 in the first direction 15. Also, a pair of a spur 46 and third conveyor rollers 45 are provided downstream of the second conveyor rollers 62 in the first direction 15. Each of the roller pairs is rotated while nipping the recording sheet 12 to convey the recording sheet 12.

The first conveyor roller 60 is rotated by a driving power transmitted from the conveyor motor 71. The conveyor motor 71 is rotatable in its forward direction and reverse direction. When a driving power produced by the forward rotation of the conveyor motor 71 is transmitted to the first conveyor roller 60, the first conveyor roller 60 is rotated in a first rotational direction. Here, the first rotational direction is a direction for conveying the recording sheet 12 in the first direction 15. When a driving power produced by the reverse rotation of the conveyor motor 71 is transmitted to the first conveyor roller 60, the first conveyor roller 60 is rotated in a second rotational direction that is reverse to the first rotational direction to convey the recording sheet 12 in a direction opposite to the first direction 15. The first conveyor roller 60 transmits the driving power to the second conveyor rollers 62 via a drive-power transmitting mechanism 50 (see FIGS. 3-6) which will be described below.

It is noted that, in the present embodiment, the first conveyor roller 60 contacts a recording face of the recording sheet 12 conveyed through the first conveyance path 65 (i.e., a face of the sheet on which an image is recorded by the recording portion 24 which will be described below), and each of the second conveyor rollers 62 and the third conveyor rollers 45 contacts a face of the recording sheet 12 which is on a back of the recording face. That is, when the first conveyor roller 60 is rotated in the first rotational direction to convey the recording sheet 12 in the first direction 15, the second conveyor rollers 62 and the third conveyor rollers 45 are rotated in the second rotational direction. On the other hand, when the first conveyor roller 60 is rotated in the second rotational direction, each of the second conveyor rollers 62 and the third conveyor rollers 45 is rotated in the first rotational direction.

In the duplex image recording, the conveying direction of the recording sheet 12 conveyed through the first conveyance path 65 is switched at a position between the second conveyor rollers 62 and the third conveyor rollers 45 such that the recording sheet 12 is conveyed to a second conveyance path 67 which will be described below.

<Manual, Tray 22>

As illustrated in FIG. 2, a manual tray 22 is disposed at a rear or back face of the printing section 11. The manual tray 22 can support various sizes of the recording sheets 12.

When the recording sheet 12 is placed on the manual tray 22, as illustrated in a two-dot chain line in FIG. 2, the recording sheet 12 is inserted into a manual-tray path 39. The manual-tray path 39 is a path extending generally frontward from the rear face of the printing section 11. The manual-tray path 39 is merged with the first conveyance path 65 at a position located upstream of a sensor 160 which will be described below in the first direction 15. The manual-tray path 39 is defined by a first upper guide member 36 and a first lower guide member 37 which are opposed to each other at a predetermined distance therebetween.

The recording sheet 12 is placed on the manual tray 22 such that a leading edge of the recording sheet 12 contacts nip portions of the first conveyor roller 60 and the pinch rollers 61. As a result, the recording sheet 12 placed on the manual tray 22 can be supplied to the recording portion 24.

<Recording Portion 24>

As illustrated in FIG. 2, the recording portion 24 is provided downstream of the first conveyor roller 60 and upstream of the second conveyor rollers 62 in the first direction 15. A platen 42 is provided under the recording portion 24 so as to be opposed to the recording portion 24. The platen 42 supports the recording sheet 12 conveyed through the first conveyance path 65. The recording portion 24 employs a well-known ink-jet ejection method to record an image on the recording sheet 12 supported on the platen 42. The recording portion 24 includes: a recording head 38 having a nozzle face 43 that has a multiplicity of nozzles through which the recording head 38 ejects ink droplets onto the recording sheet 12; and a carriage 40 for holding the recording head 38 mounted thereon.

The carriage 40 is supported by, e.g., a frame of the printing section so as to be reciprocable in main scanning directions that coincide with the right and left directions 9 perpendicular to the front and rear directions 8. The carriage 40 is coupled to a carriage drive motor 53 (see FIG. 8) by a well-known belt mechanism. Upon receipt of a driving power transmitted from the carriage drive motor 53 via the belt mechanism, the carriage 40 is reciprocated in the right and left directions 9. This reciprocation of the carriage 40 is performed in a state in which the recording sheet 12 is supported on the platen 42. The recording head 38 ejects ink droplets from the nozzles in the reciprocation of the carriage 40. As a result, an image is recorded on the recording sheet 12 supported on the platen 42.

<Sensor 160>

As illustrated in FIG. 2, the sensor 160 is provided in the first conveyance path 65 at a position upstream of the first conveyor roller 60 in the first direction 15. The sensor 160 includes: a shaft 161; a detector 162 pivotable about the shaft 161; and an optical sensor 163 that includes a light emitting element and a light receiving element for receiving light emitted from the light emitting element.

One end of the detector 162 projects from the inner guide member 19 into the first conveyance path 65. When an external force is not applied to the one end of the detector 162, the other end of the detector 162 is located in a light path extending from the light emitting element to the light receiving element to interrupt the light traveling through the light path. In this state, the optical sensor 163 outputs a low-level signal (as one example of a second signal) to a controller 130 which will be described below. When the one end of the detector 162 is pressed by a downstream edge (i.e., the leading edge) of the recording sheet 12 in the first direction 15 to rotate the detector 162, the other end of the detector 162 is moved out of the light path, causing the light to pass through the light path. In this state, the optical sensor 163 outputs a high-level signal (as one example of a first signal) to the controller 130. When an upstream edge (i.e., a trailing edge) of the recording sheet 12 in the first direction 15 is moved off the one end of the detector 162, the other end of the detector 162 enters into the light path again, causing the optical sensor 163 to output the low-level signal to the controller 130. On the basis of the signal received from the optical sensor 163, the controller 130 senses the downstream edge and the upstream edge of the recording sheet 12 in the first direction 15.

In view of the above, the sensor 160 outputs the high-level signal to the controller 130 in the state in which the one end of the detector 162 is pressed by the recording sheet 12, in other words, in a state in which the recording sheet 12 is present at a position of the detector 162, and the sensor 160 outputs the low-level signal to the controller 130 in the state in which the one end of the detector 162 is not pressed by the recording sheet 12, in other words, in a state in which the recording sheet 12 is absent at the position of the detector 162.

<Rotary Encoder 73>

Figure 3:
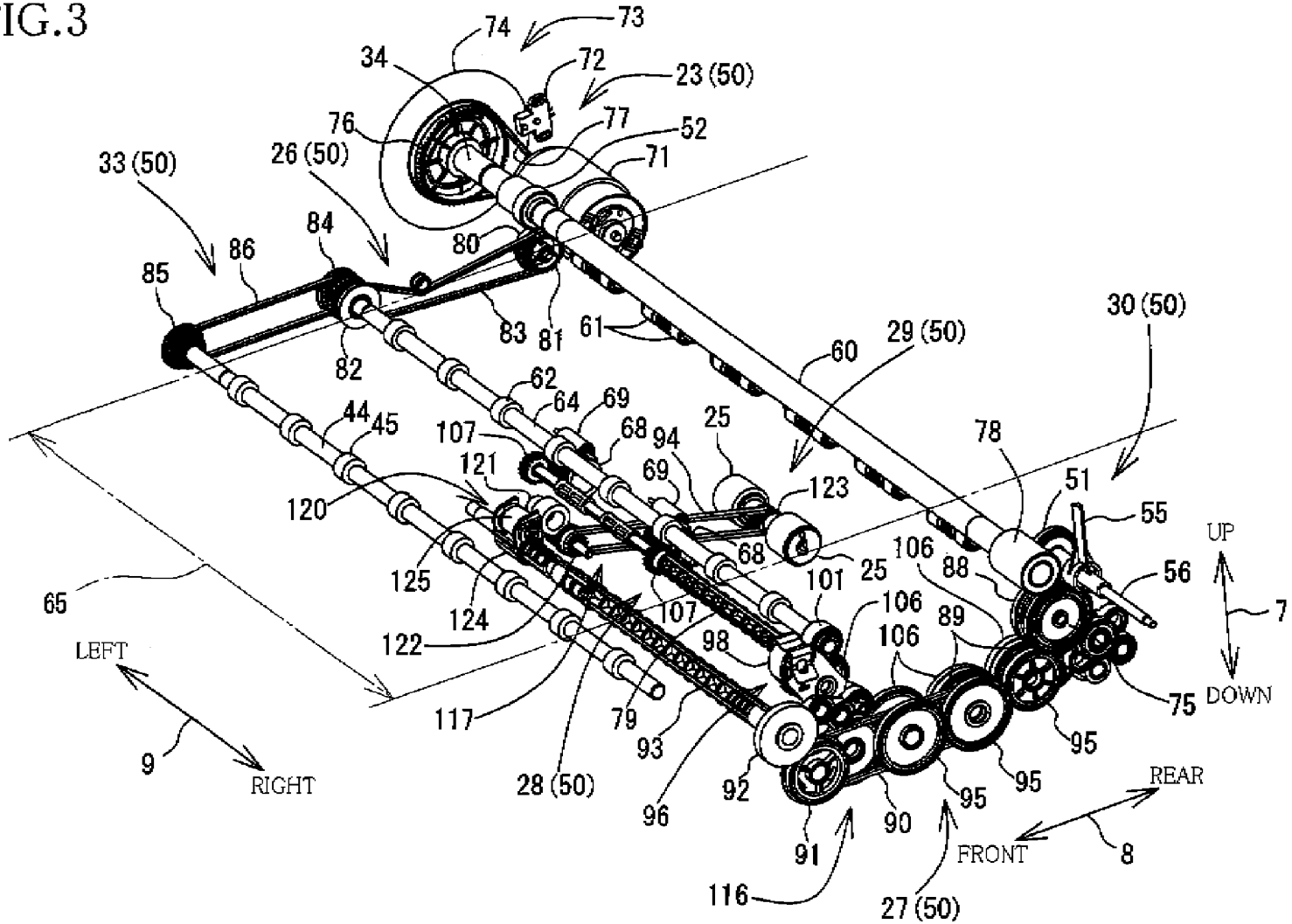
FIG. 3 is a perspective view illustrating a drive-power transmitting mechanism 50 and conveyor rollers 60, 62, 45.

As illustrated in FIGS. 2 and 3, the first conveyor roller 60 is provided with a rotary encoder 73 that produces a pulse signal in response to the rotation of the first conveyor roller 60. The rotary encoder 73 includes an optical sensor 72 and an encoder disc 74 provided on a shaft 34 of the first conveyor roller 60 so as to be rotated along with the first conveyor roller 60. The encoder disc 74 includes: light transmitting portions allowing light to pass therethrough; and light intercepting portions inhibiting the light from passing therethrough. These light transmitting portions and light intercepting portions are alternately arranged at regular pitches in a circumferential direction so as to form a predetermined pattern. The rotary encoder 73 produces a pulse signal each time when the light transmitting portion and the light intercepting portion are sensed by the optical sensor 72 during the rotation of the encoder disc 74. The produced pulse signals are transmitted to the controller 130. The controller 130 detects a rotational amount of the first conveyor roller 60 on the basis of the pulse signals. As will be described below, the conveyor rollers 60, 62, 45 are coupled to one another by belts. Thus, the controller 130 can also detect rotational amounts of the second conveyor rollers 62 and the third conveyor rollers 45 on the basis of the pulse signals produced by the optical sensor 72.

<Media Sensor 150>

As illustrated in FIG. 2, a media sensor 150 is mounted on the carriage 40 to sense the recording sheet 12 supported on the platen 42. The media sensor 150 is provided near a lower face of the carriage 40. Also, the media sensor 150 is provided upstream of the recording head 38 (specifically, a rearmost one of the nozzles) in the first direction 15.

Figure 8:
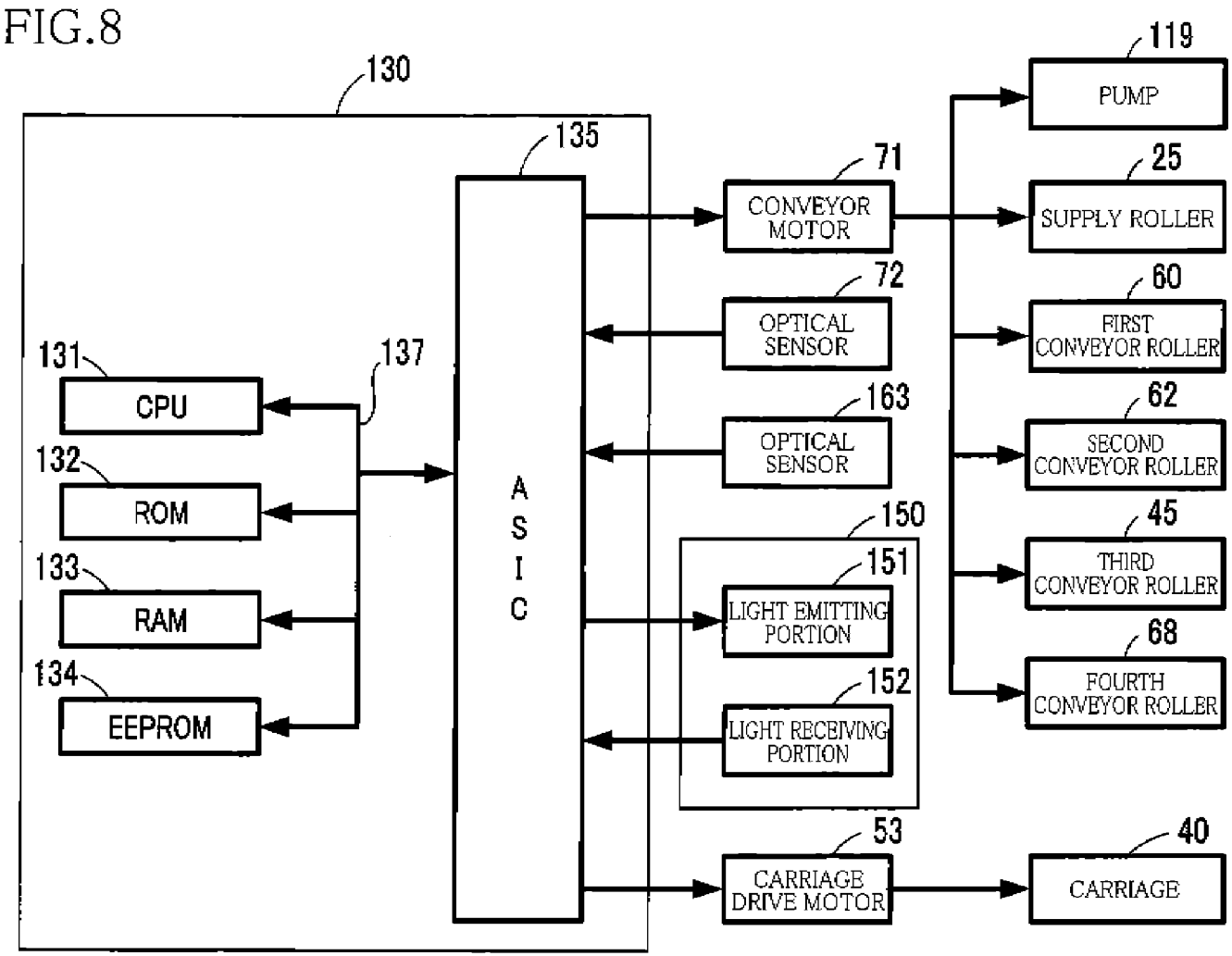
FIG. 8 is a block diagram illustrating a configuration of a controller 130.
Figure 9A:
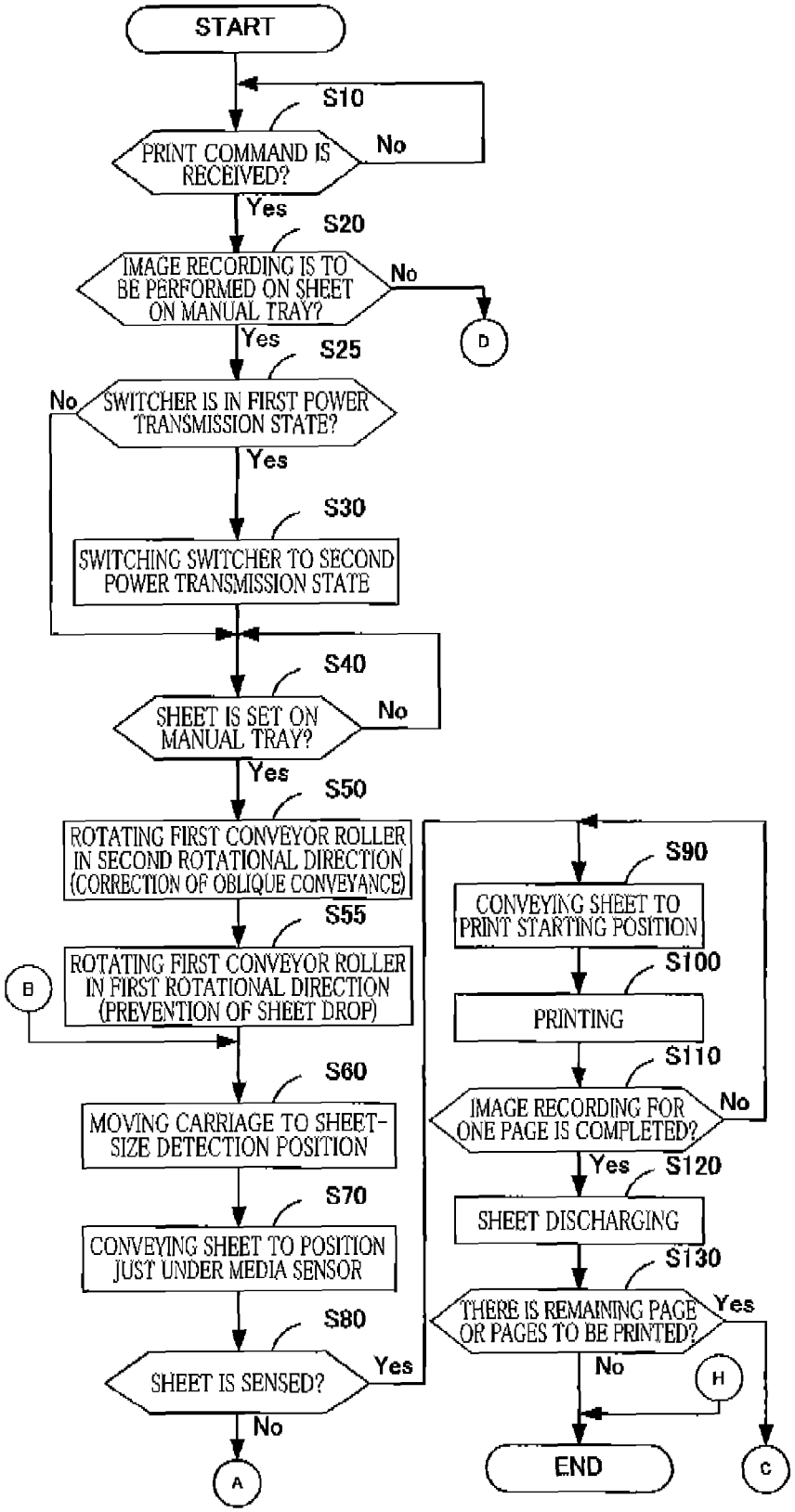
FIGS. 9A and 9B are flow charts each for explaining a control executed by the controller 130.
Figure 9B:
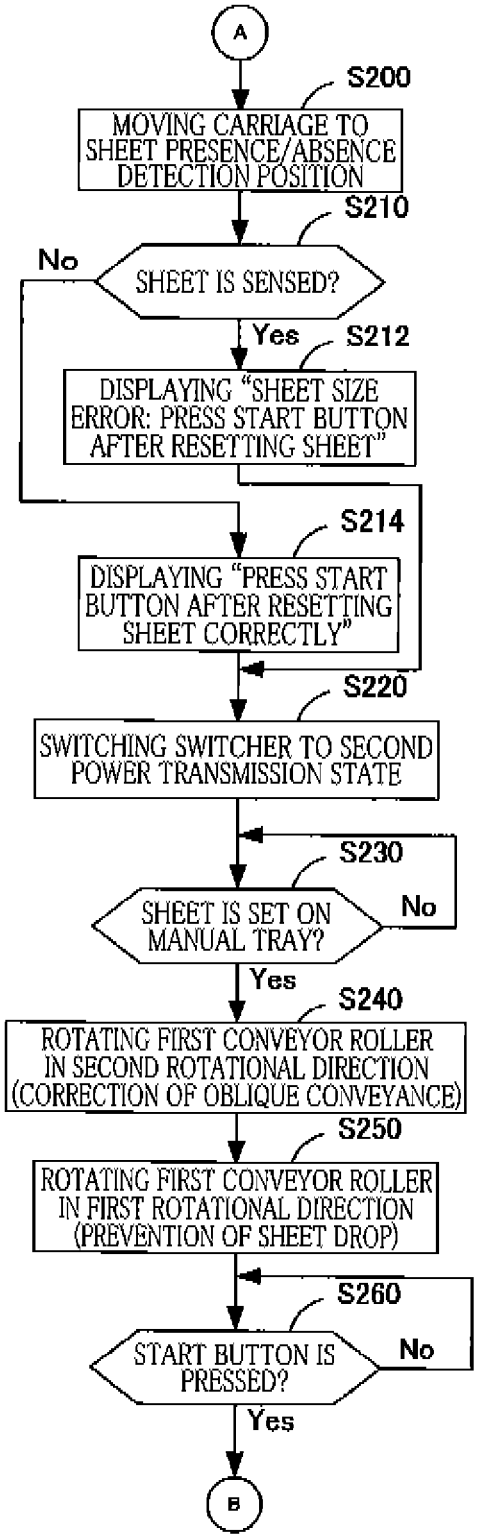
Figure 10A:
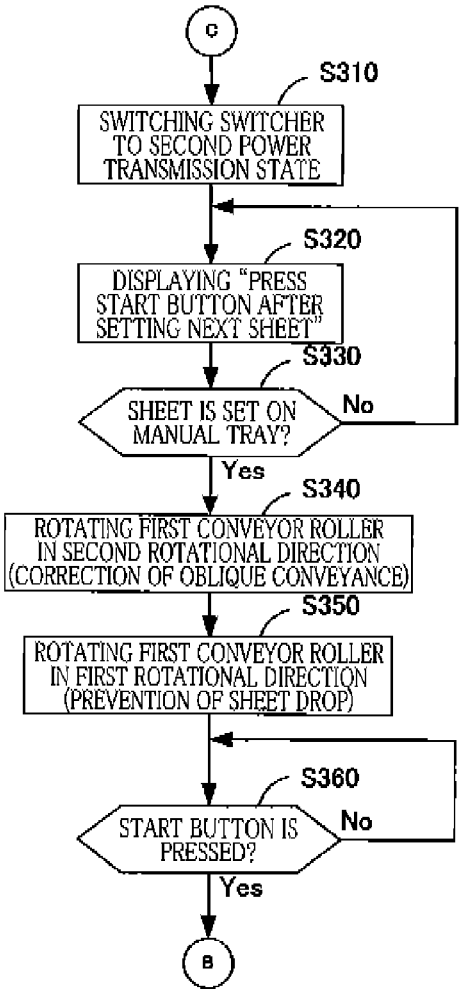
FIGS. 10A and 10B are another flow charts each for explaining a control executed by the controller 130.
Figure 10B:
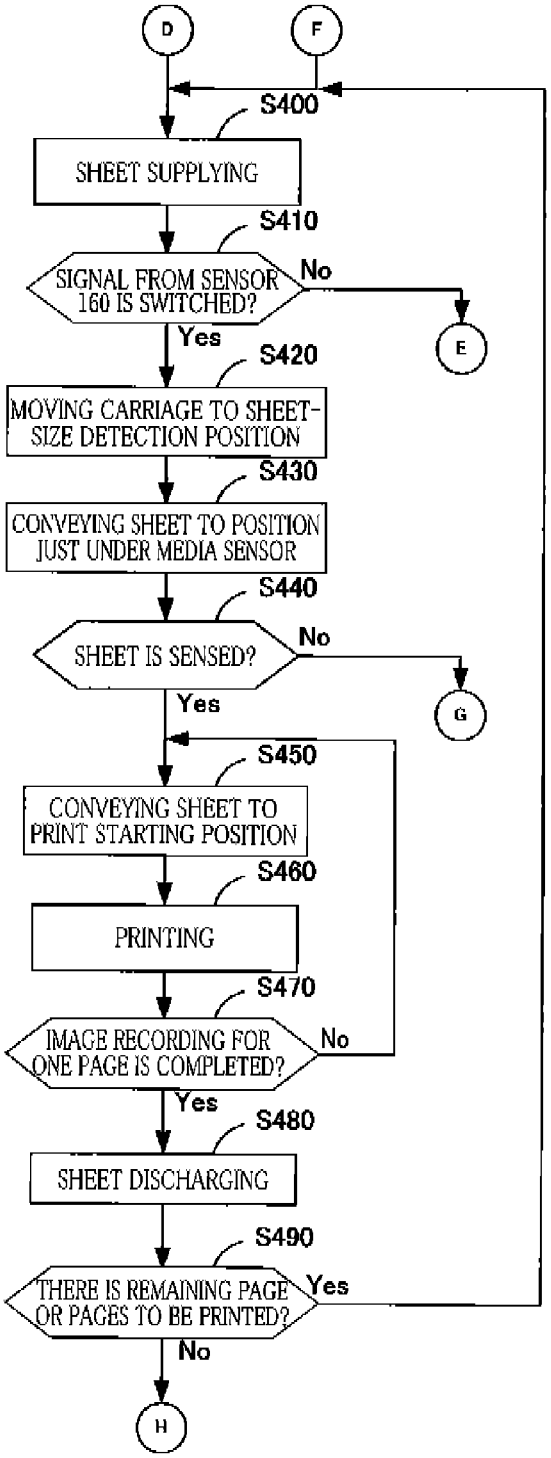
Figure 11:
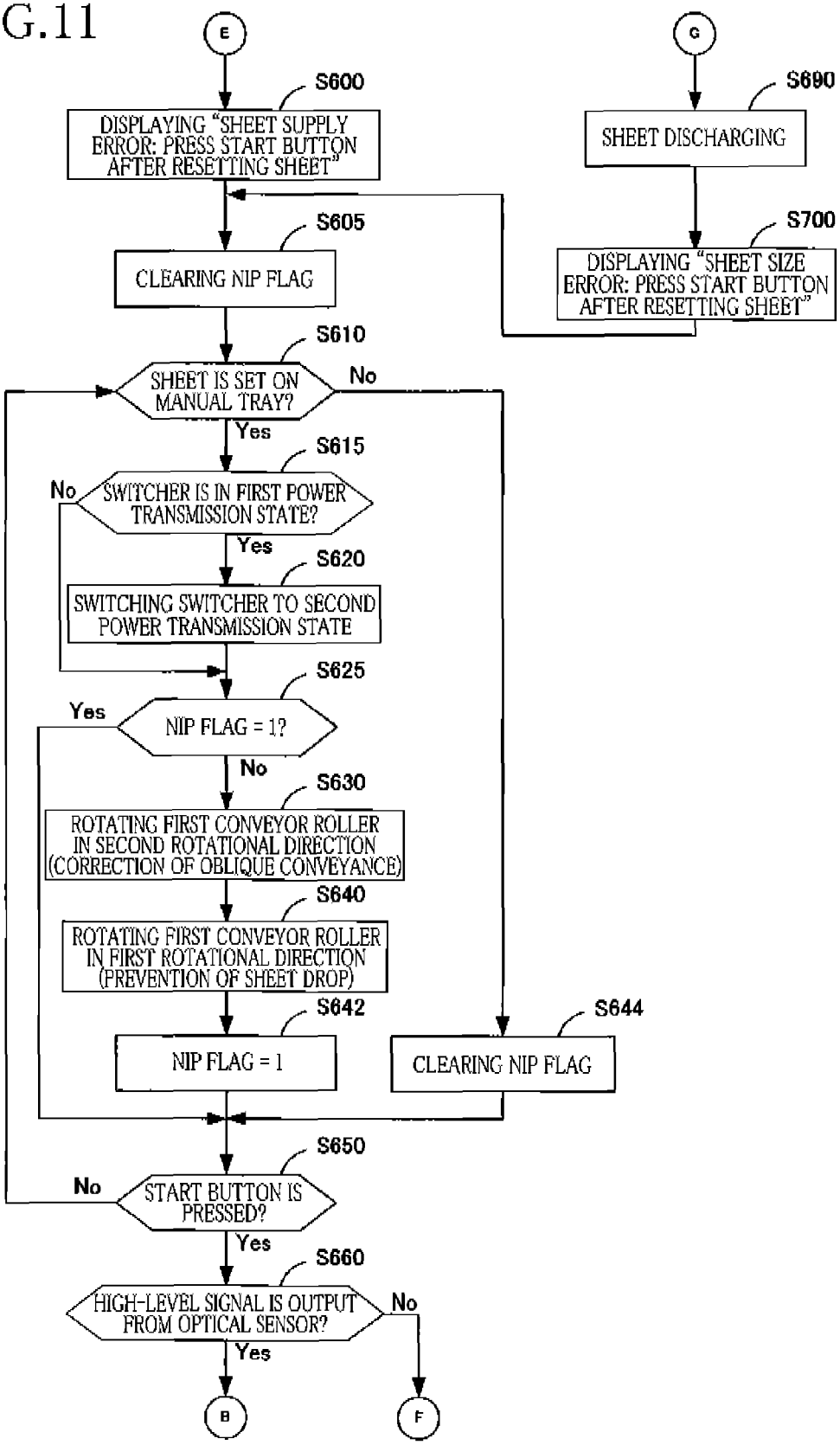
FIG. 11 is another flow chart for explaining a control executed by the controller 130.

The media sensor 150 includes a light emitting pardon 151 (see FIG. 8) and a light receiving portion 152 (see FIG. 8). The light emitting portion 151 emits light downward (i.e., toward the platen 42) by an amount commanded by the controller 130 (see FIG. 8) which will be described below. The emitted light is reflected off the platen 42 or the recording sheet 12 supported on the platen 42. The reflected light is received by the light receiving portion 152. The media sensor 150 sends the controller 130 an electric signal that is related to an amount of the reflected light received by the light receiving portion 152. For example, the larger the amount of the received light, the higher level of the electric signal the media sensor 150 outputs to the controller 130.

Path Switching Member 41 and Second Conveyance Path 67>

As illustrated in FIG. 2, a path switching member 41 is provided between the second conveyor rollers 62 and the third conveyor rollers 45. The path switching member 41 includes auxiliary rollers 47, 48, a flap 49, and a shaft 87. The flap 49 is pivotably supported by the shaft 87 so as to extend from the shaft 87 substantially in the first direction 15. The auxiliary rollers 47, 48 each having a spur shape are provided respectively on shafts provided on the flap 49.

The flap 49 is pivoted between (i) a discharge orientation indicated by broken lines in FIG. 2 which allows the recording sheet 12 to be discharged onto the output tray 21 and (ii) a flip orientation indicated by solid lines in FIG. 2 in which a free extended end portion 49A of the flap 49 is located at a position lower than that in the discharge orientation.

In a standby state of the MFP 10, the flap 49 is located at the flip orientation by its own weight. When the recording sheet 12 conveyed through the first conveyance path 65 comes into contact with the flap 49, the flap 49 is moved upward so as to be pivoted to the discharge orientation. The flap 49 (specifically, the auxiliary rollers 47, 48) thereafter guides the recording sheet 12 while contacting the recording sheet 12. When the upstream edge of the recording sheet 12 in the first direction 15 passes through the auxiliary roller 47, the flap 49 is pivoted by its own weight from the discharge orientation to the flip orientation. As a result, the upstream edge of the recording sheet 12 in the first direction 15 is moved downward so as to be directed toward (i.e., so as to face or point) the second conveyance path 67 which will be described below: When the third conveyor rollers 45 continue to be rotated in the second rotational direction in this state, the recording sheet 12 is conveyed in the first direction 15 and discharged onto the output tray 21. On the other hand, when a rotational direction, of the third conveyor rollers 45 is switched to the first rotational direction, the recording sheet 12 is conveyed in the direction opposite to the first direction 15 so as to enter into the second conveyance path 67.

The second conveyance path 67 is branched from a position between the second conveyor rollers 62 and the third conveyor rollers 45 so as to be merged with the first conveyance path 65 at a position upstream of the first conveyor roller 60 in the first direction 15. It is noted that the second conveyance path 67 is defined by a second upper guide member 31 and a second lower guide member 32 which are opposed to each other at a predetermined distance therebetween.

<Fourth Conveyor Rollers 68>

As illustrated in FIG. 2, fourth conveyor rollers 68 and a driven roller 69 are provided in the second conveyance path 67. The fourth, conveyor rollers 68 are disposed in the second conveyance path 67 at a position under and opposite to the driven roller 69.

The driving power of the conveyor motor 71 is transmitted to the fourth conveyor rollers 68 via a fourth power transmitter 28 of the drive-power transmitting mechanism 50 which will be described below. Upon receipt of the driving power, the fourth conveyor rollers 68 are rotated in such a direction that the recording sheet 12 is conveyed in a second direction 16 along the second conveyance path 67. Specifically, the fourth conveyor rollers 68 are rotated only in the counterclockwise direction (i.e., the first rotational direction) in FIGS. 2 and 4. Here, the second direction 16 is a direction directed along the second conveyance path 67 from the position between the second conveyor rollers 62 and the third conveyor rollers 45 toward a position located upstream of the first conveyor roller 60 in the first direction 15. This second direction 16 is indicated by two-dot chain-line arrow in FIG. 2.

In view of the above, when the recording sheet 12 conveyed into the second conveyance path 67 by the third conveyor rollers 45 is nipped between the fourth conveyor rollers 68 and the driven roller 69, the recording sheet 12 is conveyed by the fourth conveyor rollers 68 in the second direction 16. As a result, the recording sheet 12 is delivered to a position located upstream of the first conveyor roller 60 in the first direction 15, Power transmission from the conveyor motor 71 to the fourth conveyor rollers 68 will be explained later.

<Maintenance Mechanism 170>

Figure 7A:
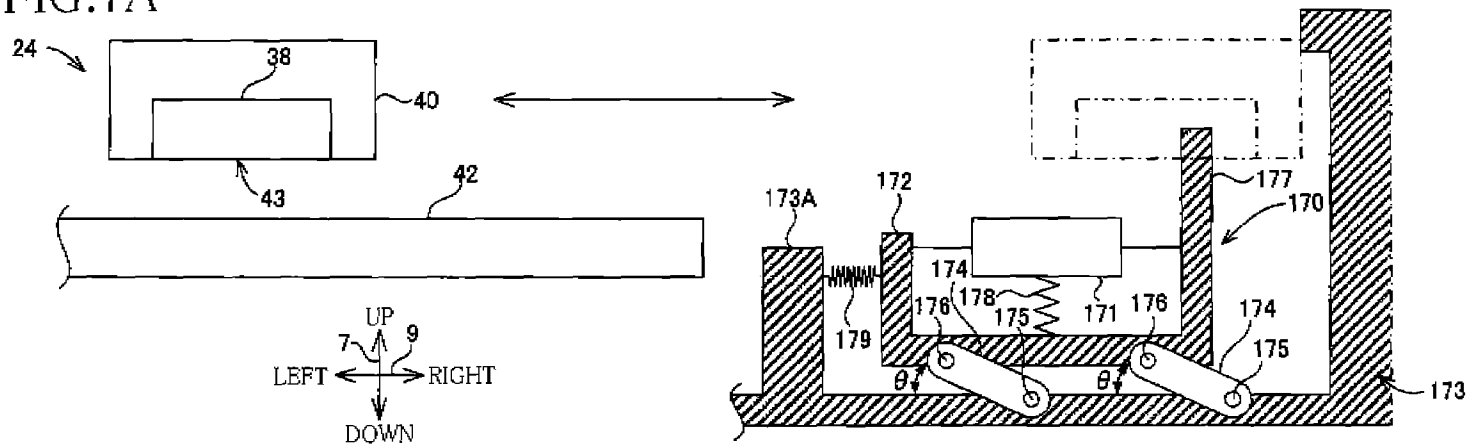
Figure 7B:
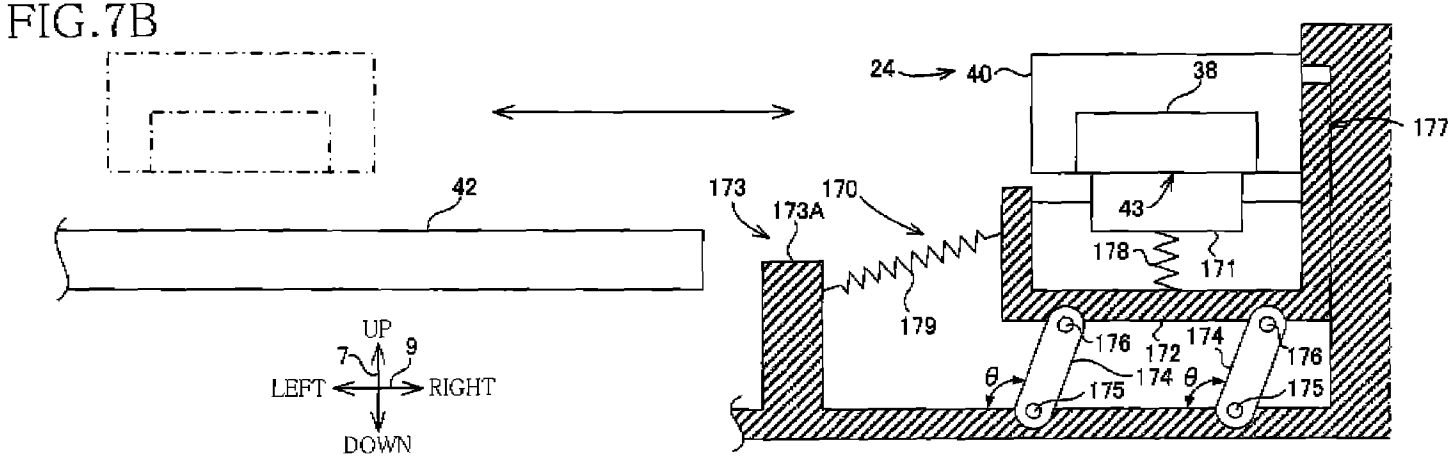

As illustrated in FIG. 7, a maintenance mechanism 170 is disposed within a moving range that is an area on which the carriage 40 can be reciprocated in the right and left directions 9. Specifically, within the moving range, the maintenance mechanism 170 is disposed in an area on which the recording sheet 12 is not conveyed when delivered through the first conveyance path 65, that is, the maintenance mechanism 170 is disposed outside an image recording area on which the recording head 38 records an image on the recording sheet 12. Specifically, the maintenance mechanism 170 is disposed on a right side of the platen 42. The maintenance mechanism 170 is provided to prevent drying of the ink in the nozzles of the recording head 38 and to suck and remove air bubbles and foreign matters from the nozzles. The maintenance mechanism 170 includes: a cap 171; a first frame 172 for supporting the cap 171; a second frame 173 for supporting the first frame 172; four leg portions 174 (only two of which are illustrated in FIGS. 7A and 7B) connecting between the first frame 172 and the second frame 173; a tube, not shown; a pump 119 (see FIG. 8); and a waste-ink tank, not shown.

When the carriage 40 is moved to a position (indicated by one-dot chain lines in FIG. 7A) right above the maintenance mechanism 170, the cap 171 covers, as illustrated in FIG. 7B, the nozzle face 43 of the recording head 38 (specifically, the nozzles formed in the nozzle face 43). The cap 171 is supported by the first frame 172. In the present embodiment, the cap 171 is elastically supported and urged in the up and down directions 7 by a coil spring 178 that is provided between a lower portion of the cap 171 and a bottom face of the first frame 172.

Each of the leg portions 174 has two through holes at its opposite end portions, and shafts 175, 176 are respectively fitted through the through holes. The shaft 175 provided at one of the end portions is pivotably mounted on the second frame 173, and the shaft 176 provided at the other of the end portions is pivotably mounted on the first frame 172. As a result, a state of the first flume 172 and the cap 171 can be switched between a separated state (see FIG. 7A) and a capping state (see FIG. 7B). In the separated state, each of the leg portions 174 is inclined such that its upper portion is located near a bottom face of the second frame 173, and an angle θ of the leg portion 174 with respect to the bottom face of the second frame 173 is the smallest. In the capping state, on the other hand, the leg portion 174 stands generally upright such that its upper portion is far from the bottom face of the second frame 173, and the above-described angle θ is the largest. The cap 171 covers the nozzle face 43 in the capping state and is spaced apart from the nozzle face 43 in the separated state.

When the cap 171 is in the capping state, a space is formed between the cap 171 and the nozzle face 43. Although not shown, an air suction opening is formed in the cap 171. The air suction opening is coupled to the waste-ink tank by the tube.

The pump 119 (see FIG. 8) is provided on the tube that connects between the air suction opening and the waste-ink tank. The pump 119 is a rotary tube pump. In the present embodiment, the pump 119 includes a casing having inner wall faces; and a roller that rolls along the inner wall face. The tube is disposed between the roller and the inner wall face. When the roller is driven and rolled, the tube is squeezed by the roller to push the ink in the tube from an upstream side (i.e., an air-suction-opening side) toward a downstream side (i.e., a waste-ink-tank side).

The first frame 172 is provided with a lever 177 (as one example of a cap-state switcher) standing upright from the bottom face. The lever 177 is provided on a right wall of the first frame 172. The lever 177 is extended to the moving range (i.e., a moving path) of the carriage 40, and the carriage 40 is brought into contact with a distal end portion of the lever 177.

A coil spring 179 is provided so as to be bridged between a left side face of the first frame 172 and a protruding portion 173A protruding from the second frame 173. The coil spring 179 has a natural length when the cap 171 is in the separated state (see FIG. 7A). On the other hand, the coil spring 179 is stretched when the cap 171 is in the capping state (see FIG. 7B). That is, the coil spring 179 elastically urges the cap 171 toward a separated-state side.

In the state in FIG. 7A, i.e., in the separated state of the cap 171, when the carriage 40 is moved toward the maintenance mechanism 170, i.e., in a right direction and brought into contact with the lever 177, the lever 177 is pushed or pressed by the carriage 40 in the right direction. When a pushing force in the right direction is received by the lever 177, the first frame 172 is slid in the right direction against an elastic force of the coil spring 179. As a result, the first frame 172 is moved in the right direction, so that the cap 171 is switched from the separated state to the capping state (see FIG. 7B).

In the state in FIG. 7B, i.e., in the capping state of the cap 171, when the carriage 40 is moved in a left direction and comes off the lever 177, the lever 177 is slid in the left direction by the elastic force of the coil spring 179. As a result, the first frame 172 is moved in the left direction, so that the cap 171 is switched from the capping state to the separated state (see FIG. 7A).

<Drive-Power Transmitting Mechanism 50>

Figure 4:
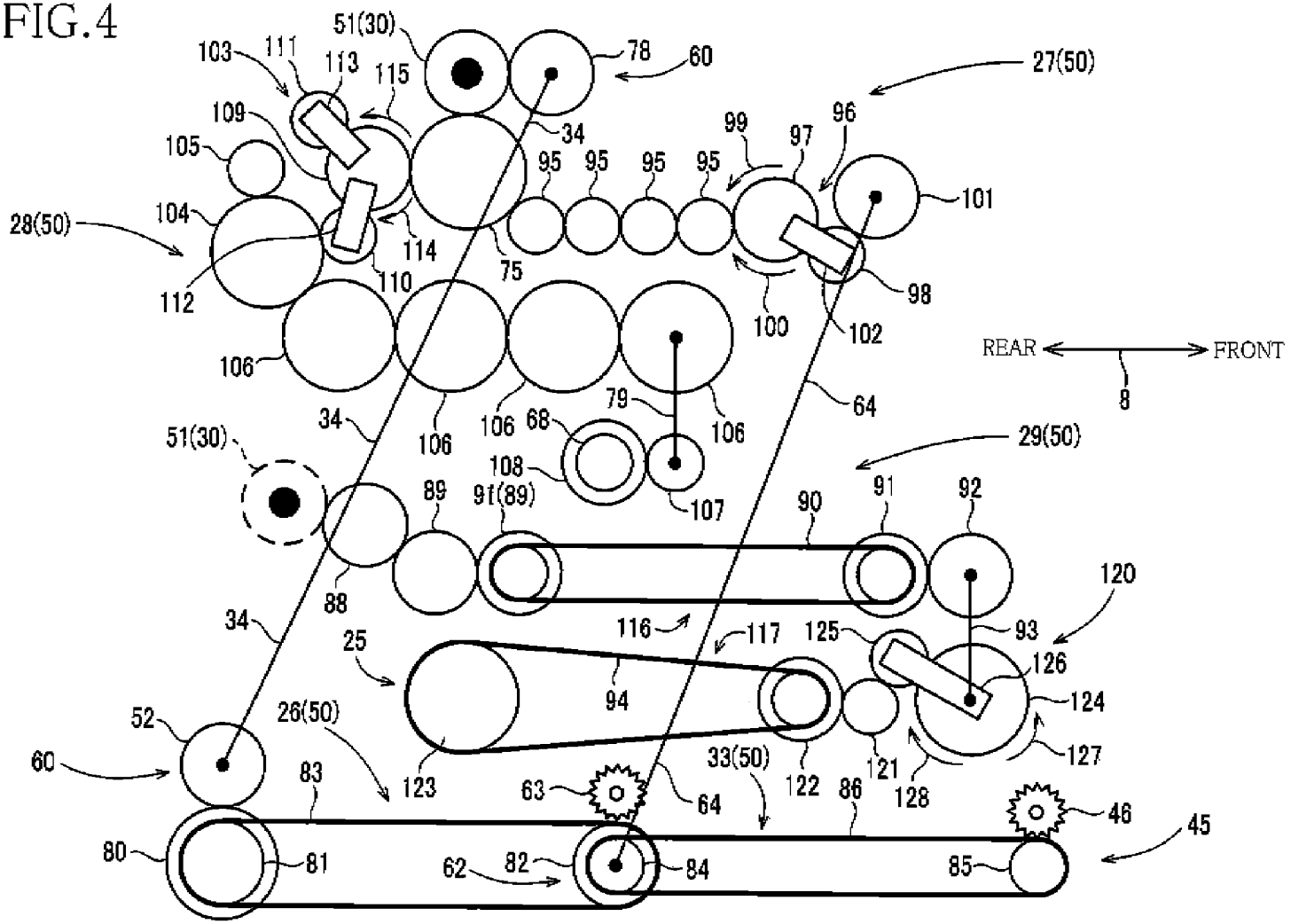
FIG. 4 is a schematic view of the drive-power transmitting mechanism 50 as seen from a left side, illustrating a power-transmission relationship among rollers, belts, gears, and pulleys of the drive-power transmitting mechanism 50.

As illustrated in FIGS. 3 and 4, the drive-power transmitting mechanism 50 is provided in the printing section 11. The drive-power transmitting mechanism 50 includes a conveyance power transmitter 23 (as one example of a conveyance driving power transmitter), a first power transmitter 26, a second power transmitter 27, a third power transmitter 33, the fourth power transmitter 28, a supply power transmitter 29 (as one example of a supply driving power transmitter), a fifth power transmitter 59 (see FIG. 6), and a switcher 30.

As illustrated in FIG. 5, the drive-power transmitting mechanism 50 causes the rollers 60, 62, 45, 68, 25 to be rotated so as to convey the recording sheet 12 in their respective directions described in FIG. 5. That is, the drive-power transmitting mechanism 50 causes the rollers 60, 62, 45, 68, 25 to be rotated depending upon a position of a switch gear 51 of the switcher 30 and the rotational direction of the conveyor motor 71. The rollers 60, 62, 45, 68, 25 are rotated by the rotational drive power transmitted from the conveyor motor 71 via the conveyance power transmitter 23 and any of the first power transmitter 26, the second power transmitter 27, the third power transmitter 33, the fourth power transmitter 28, and the supply power transmitter 29. It is noted that in FIG. 5 each of the rollers 60, 62, 45, 68, 25 receives the rotational driving power from the conveyor motor 71 via a transmitter whose name is described in corresponding parentheses.

<Conveyance Power Transmitter 23>

As illustrated in FIG. 3, the conveyance power transmitter 23 includes a roller pulley 76 (as one example of a conveyance pulley), a motor pulley, not shown, and a first belt 77. The roller pulley 76 is mounted on the shaft 34 of the first conveyor roller 60 at a left end portion of the first conveyor roller 60. When the first conveyor roller 60 is rotated, the roller pulley 76 is also rotated. That is, the roller pulley 76 is provided coaxially with the first conveyor roller 60 and rotated together with the first conveyor roller 60. The motor pulley is mounted on a rotation shaft of the conveyor motor 71. The endless first belt 77 is looped over the roller pulley 76 and the motor pulley. As a result, the rotational driving power of the conveyor motor 71 is transmitted to the first conveyor roller 60. Specifically, when the conveyor motor 71 is rotated in the forward direction, the first conveyor roller 60 is rotated in the first rotational direction, and when the conveyor motor 71 is rotated in the reverse direction, the first conveyor roller 60 is rotated in the second rotational direction.

<First Power Transmitter 26>

As illustrated in FIGS. 3 and 4, the first power transmitter 26 includes a left gear 52, a lower gear 80, a first pulley 81, a second pulley 82, and a second belt 83. The left gear 52 is mounted on the shaft 34 of the first conveyor roller 60 on a left side of the first conveyance path 65. The lower gear 80 is provided under the left gear 52 so as to be in meshed engagement with the left gear 52. The first pulley 81 is mounted on a right face of the lower gear 80 so as to be rotated coaxially and together with the lower gear 80. As a result, the first pulley 81 is rotated along with the rotation of the first conveyor roller 60. The second pulley 82 is mounted on a shaft 64 of the second conveyor rollers 62. The endless second belt 83 is looped over the first pulley 81 and the second pulley 82. As a result, the rotation of the first conveyor roller 60 rotates the second belt 83, causing the second conveyor rollers 62 to be rotated with the rotation of the first conveyor roller 60 by receiving the rotational driving power transmitted from the first conveyor roller 60.

<Third Power Transmitter 33>

As illustrated in FIGS. 3 and 4, the third power transmitter 33 includes a third pulley 84, a fourth pulley 85, and a third belt 86. The third pulley 84 is mounted on the shaft 64 on a left side of the second pulley 82 so as to be rotated coaxially and together with the second pulley 82. The fourth pulley 85 is mounted on a shaft 44 of the third conveyor rollers 45. The endless third belt 86 is looped over the third pulley 84 and the fourth pulley 85. As a result, the rotational (halving power of the second conveyor rollers 62 is transmitted to the third conveyor rollers 45. That is, the third conveyor rollers 45 are rotated with the rotation of the second conveyor rollers 62 by receiving the rotational driving power from the second conveyor rollers 62.

In the following explanation, each of the clockwise direction, i.e., the second rotational direction and the counterclockwise direction, i.e., the first rotational direction is a rotational direction of each roller and each gear in FIG. 4. That is, each of the clockwise direction and the counterclockwise direction is a rotational direction of each roller and each gear when each roller and each gear are seen from the left side. Accordingly, it is to be understood that when each roller and each gear are seen from the right side, for example, the clockwise direction and the counterclockwise direction respectively coincide with the first rotational direction and the second rotational direction. A well-known one-way clutch (specifically, a needle clutch) is provided inside the second pulley 82. That is, the second pulley 82 is mounted on the shaft 64 via the one-way clutch. As a result, as illustrated in FIG. 4, in the present embodiment, when the conveyor motor 71 is rotated in the forward direction, the shaft 64 is rotated in the clockwise direction, i.e., the second rotational direction, but when the conveyor motor 71 is rotated in the reverse direction, the shaft 64 is not rotated. Accordingly, when the conveyor motor 71 is rotated in the forward direction, the forward rotational driving power is transmitted to the conveyor rollers 60, 62, 45, causing the conveyor rollers 60, 62, 45 to be rotated so as to convey the recording sheet 12 in the first direction 15. Specifically, in the present embodiment, the first conveyor roller 60 is rotated in the counterclockwise direction, i.e., the first rotational direction, and each of the second conveyor rollers 62 and the third conveyor rollers 45 is rotated in the clockwise direction, i.e., the second rotational direction. On the other hand, when the conveyor motor 71 is rotated in the reverse direction, the reverse rotational driving power is transmitted to the first conveyor roller 60, but the second pulley 82 slips on the shaft 64 by the one-way clutch. Thus, the reverse rotational driving power is not transmitted to the second conveyor rollers 62. As a result, only the first conveyor roller 60 is rotated in the clockwise direction, i.e., the second rotational direction so as to convey the recording sheet 12 in the direction opposite to the first direction 15, and the second conveyor rollers 62 and the third conveyor rollers 45 are not rotated.

<Second Power Transmitter 27>

As illustrated in FIGS. 3 and 4, the second power transmitter 27 includes: a first gear 78; a second gear 101; a first output gear 75; a plurality of first intermediate gears 95 meshed with one another; and a first planetary gear mechanism 96. The first planetary gear mechanism 96 includes: a sun gear 97 meshed with a frontmost one of the first intermediate gears 95; a planetary gear 98 rotatable while revolving around the sun gear 97; and an arm 102. In the present embodiment, the first gear 78 is one example of the supply power transmitter 29 which will be described below.

The first gear 78 is mounted on the shaft 34 of the first conveyor roller 60 at a right end portion of the first conveyor roller 60. When the first conveyor roller 60 is rotated, the first gear 78 is also rotated. That is, the first gear 78 is provided coaxially with the first conveyor roller 60 and rotated together with, the that conveyor roller 60. As a result, the rotational driving power is transmitted from the first gear 78 to the first output gear 75 via the switch gear 51 of the switcher 30 which will be described below.

The first output gear 75 is in meshed engagement with: the switch gear 51; a rearmost one of the first intermediate gears 95; and a sun gear 109 of a second planetary gear mechanism 103 of the fourth power transmitter 28 which will be described below. It is noted that, as will be described below, when the switch gear 51 is located at a second power transmission position, the first output gear 75 is meshed with the switch gear 51, so that the rotational driving power is transmitted from the first gear 78 to the first output gear 75 (see FIG. 6B).

The first intermediate gears 95 are arranged substantially in the front and rear directions 8 in a state in which the first intermediate gears 95 are meshed with one another. In the present embodiment, an even number of the first intermediate gears 95 are arranged. It is to be understood that, while the four first intermediate gears 95 are illustrated in FIG. 6, the number of the first intermediate gears 95 is not limited to four. The frontmost first intermediate gear 95 is meshed with the sun gear 97 of the first planetary gear mechanism 96. In view of the above, the rotational driving power of the first gear 78 is transmitted to the sun gear 97 via the first output gear 75 and the first intermediate gears 95.

The sun gear 97 is rotatably supported by, e.g., the frame of the printing section 11. The sun gear 97 has a thrust face on which one end of the arm 102 is mounted. As a result, the arm 102 is rotated coaxially with the sun gear 97. The planetary gear 98 is rotatably supported on the other end of the arm 102. The planetary gear 98 is in meshed engagement with the sun gear 97. Thus, the planetary gear 98 is rotated while supported by the arm 102 and is revolved in a rotational direction of the sun gear 97 while meshed with the sun gear 97.

There will be next explained power transmission of the second power transmitter 27 with reference to FIG. 4. When the conveyor motor 71 (see FIGS. 3 and 8) is rotated in the reverse direction, each of the first conveyor roller 60 and the first gear 78 is rotated in the clockwise direction, i.e., the second rotational direction. Here, the switch gear 51, the first output gear 75, and the even number of the first intermediate gears 95 are provided between the first gear 78 and the sun gear 97, that is, an even number of gears are arranged in series between the first gear 78 and the sun gear 97 in a state in which these gears are meshed with one another. Thus, when the first gear 78 is rotated in the clockwise direction, the sun gear 97 is rotated in the counterclockwise direction, i.e., in a direction indicated by arrow 99.

When the sun gear 97 is rotated in the counterclockwise direction, the planetary gear 98 is revolved around the sun gear 97 in the direction indicated by arrow 99. As a result, the planetary gear 98 is connected to and meshed with the second gear 101. Here, the second gear 101 is mounted on a right end portion of the shaft 64 of the second conveyor rollers 62 (see FIG. 3) and rotated together with the second conveyor rollers 62. When the planetary gear 98 and the second gear 101 are connected to and meshed with each other, the planetary gear 98 stops revolving and starts rotating. A direction of the rotation of the planetary gear 98 is the clockwise direction. Thus, when the planetary gear 98 is rotated, the second gear 101 connected to and meshed with the planetary gear 98, i.e., the second conveyor rollers 62 are rotated in the counterclockwise direction, the first rotational direction, that is, the second conveyor rollers 62 are rotated in the direction in which the recording sheet 12 is conveyed in the direction opposite to the first direction 15.

The rotational driving power of the second conveyor rollers 62 in the counterclockwise direction, i.e., the first rotational direction is transmitted to the third conveyor rollers 45 via the third pulley 84, the third belt 86, and the fourth pulley 85. As a result, the third conveyor rollers 45 are also rotated in the counterclockwise direction, i.e., the first rotational direction, that is, the third conveyor rollers 45 are also rotated in the direction in which the recording sheet 12 is conveyed in the direction opposite to the first direction 15.

On the other hand, when the conveyor motor 71 is rotated in the forward direction, the first gear 78 and the sun gear 97 are rotated in the clockwise direction in contrast to the above-described case. Thus, the planetary gear 98 is revolved around the sun gear 97 in a direction indicated by arrow 100. As a result, the planetary gear 98 is disconnected from the second gear 101. Thus, the second power transmitter 27 does not cause the rotations of the second conveyor rollers 62 and the third conveyor rollers 45.

In view of the above, the second power transmitter 27 transmits the rotational driving power of the first conveyor roller 60 in the second rotational direction to the second conveyor rollers 62. On the other hand, the second power transmitter 27 does not transmit the rotational driving power of the first conveyor roller 60 in the first rotational direction to the second conveyor rollers 62.

It is noted that, when the conveyor motor 71 is rotated in the forward direction, the forward rotational driving power of the conveyor motor 71 is transmitted to the second conveyor rollers 62 by the first power transmitter 26 and to the third conveyor rollers 45 by the third power transmitter 33 as described above. Thus, when the conveyor motor 71 is rotated in the forward direction, the conveyor rollers 60, 62, 45 are rotated so as to convey the recording sheet 12 in the first direction 15. That is, the first conveyor roller 60 is rotated in the counterclockwise direction, i.e., the first rotational direction, and the second conveyor rollers 62 and the third conveyor rollers 45 are rotated in the clockwise direction, i.e., the second rotational direction.

<Fourth Power Transmitter 28>

As illustrated in FIGS. 3 and 4, the fourth power transmitter 28 includes: the second planetary gear mechanism 103; a forward-rotation meshing gear 104; a reverse-rotation meshing gear 105; a plurality of second intermediate gears 106 meshed with one another; third intermediate gears 107; and a third gear 108. The second planetary gear mechanism 103 includes: the sun gear 109 meshed with the first output gear 75; two planetary gears 110, 111 each rotatable while revolving around the sun gear 109; and two arms 112, 113.

The sun gear 109 is rotatably supported by, e.g., the frame of the printing section 11. The sun gear 109 is rotated by the driving power transmitted from the first output gear 75 of the second power transmitter 27. That is, as in the case of the second power transmitter 27, the fourth power transmitter 28 receives the driving power from the first gear 78 when the switch gear 51 is located at the second power transmission position (see FIG. 6B).

The sun gear 109 has a thrust face on which one ends of the arms 112, 113 are mounted. Thus, the arms 112, 113 are rotated coaxially with the sun gear 109. The planetary gear 110 is rotatably supported on the other end of the arm 112. The planetary gear 111 is rotatably supported on the other end of the arm 113. The planetary gears 110, 111 are in meshed engagement with the sun gear 109. In the construction described above, the planetary gear 110 is rotated while supported by the arm 112 and is revolved in a rotational direction of the sun gear 109 while meshed with the sun gear 109. Also, the planetary gear 111 is rotated while supported by the arm 113 and is revolved in a rotational direction of the sun gear 109 while meshed with the sun gear 109.

The planetary gear 110 is meshable with the forward-rotation meshing gear 104. The planetary gear 111 is meshable with the reverse-rotation meshing gear 105. The reverse-rotation meshing gear 105 is in meshed engagement with the forward-rotation meshing gear 104. In addition to the reverse-rotation meshing gear 105, the forward-rotation meshing gear 104 is in meshed engagement with a rearmost one of the second intermediate gears 106.

The second intermediate gears 106 are arranged substantially in the front and rear directions 8 in a state in which the second intermediate gears 106 are meshed with one another. In the present embodiment, an even number of the second intermediate gears 106 are arranged. It is to be understood that, while the four second intermediate gears 106 are illustrated in FIG. 6, the number of the second intermediate gears 106 is not limited to four. The third intermediate gears 107 are provided coaxially with a frontmost one of the second intermediate gears 106. The third intermediate gears 107 are rotated about a shaft 79 together with the frontmost second intermediate gear 106. The third intermediate gears 107 are in meshed engagement with the third gear 108. The third gear 108 is disposed coaxially with the fourth conveyor rollers 68 so as to be rotatable together with the fourth conveyor rollers 68.

There will be next explained power transmission of the fourth power transmitter 28 with reference to FIG. 4. When the conveyor motor 71 is rotated in the forward direction, the first conveyor roller 60 and the first gear 78 are rotated in, the counterclockwise direction, i.e., the first rotational direction, the switch gear 51 is rotated in the clockwise direction, and the first output gear 75 is rotated in the counterclockwise direction. The sun gear 109 is in turn rotated in the clockwise direction, i.e., in a direction indicated by arrow 114. As a result, the arms 112, 113 are also rotated in, the direction indicated by arrow 114. Thus, the planetary gear 110 is meshed with the forward-rotation meshing gear 104, and the planetary gear 111 is disconnected or moved away from the reverse-rotation meshing gear 105. The planetary gear 111 meshed with the forward-rotation meshing gear 104 is rotated in the counterclockwise direction, whereby the forward-rotation meshing gear 104 is rotated in the clockwise direction.

Here, the even number of the second intermediate gears 106 are arranged in series between the forward-rotation meshing gear 104 and the third gear 108 in a state in which these gears are meshed with one another. It is noted that since the third intermediate gears 107 are rotated coaxially and together with the second intermediate gears 106, the number of the third intermediate gears 107 is not included in the above-described number of the second intermediate gears 106. In view of the above, when the forward-rotation meshing gear 104 is rotated in the clockwise direction, the third gear 108 and the fourth conveyor rollers 68 are rotated in the counterclockwise direction. That is, when the conveyor motor 71 is rotated in the forward direction, the fourth conveyor rollers 68 are rotated in the counterclockwise direction, i.e., the first rotational direction.

On the other hand, when the conveyor motor 71 is rotated in the reverse direction, each of the first conveyor roller 60 and the first gear 78 is rotated in the clockwise direction, i.e., the second rotational direction, the switch gear 51 is rotated in the counterclockwise direction, and the first output gear 75 is rotated in the clockwise direction. The sun gear 109 is in turn rotated in the counterclockwise direction, i.e., in a direction indicated by arrow 115. As a result, the arms 112, 113 are also rotated in the direction indicated by arrow 115. Thus, the planetary gear 110 is disconnected or moved away from the forward-rotation meshing gear 104, and the planetary gear 111 is meshed with the reverse-rotation meshing gear 105. The planetary gear 111 meshed with the reverse-rotation meshing gear 105 is rotated in the clockwise direction, whereby the reverse-rotation meshing gear 105 is rotated in the counterclockwise direction.

Here, the forward-rotation meshing gear 104 and the even number of the second intermediate gears 106 are arranged between the reverse-rotation meshing gear 105 and the third gear 108, that is, an odd number of gears are arranged in series between the reverse-rotation meshing gear 105 and the third gear 108 in a state in which these gears are meshed with one another. In view of the above, when the reverse-rotation meshing gear 105 is rotated in the counterclockwise direction, the third gear 108 and the fourth conveyor rollers 68 are also rotated in the counterclockwise direction. That is, even when the conveyor motor 71 is rotated in the reverse direction, the fourth conveyor rollers 68 are rotated in the counterclockwise direction, i.e., the first rotational direction.

In view of the above, the fourth power transmitter 28 transmits the forward and reverse rotational driving powers of the first conveyor roller 60, i.e., both of the rotational driving power in the counterclockwise direction and the rotational driving power in the clockwise direction, to the fourth conveyor rollers 68 as the rotational driving power for conveying the recording sheet 12 in the second direction 16, i.e., the rotational driving power in the first rotational direction.

<Supply Power Transmitter 29>

As illustrated in FIGS. 3 and 4, the supply power transmitter 29 includes the first gear 78 (as one example of a conveyance gear), a second output gear 88 (as one example of a supply gear), a first transmitter 116, a third planetary gear mechanism 120, a second transmitter 117, and a supply pulley 123 that is coaxial with the supply rollers 25.

The first transmitter 116 includes a fourth intermediate gear 89, a fourth belt 90, and two fifth intermediate gears 91. The second transmitter 117 includes a seventh intermediate gear 121, an eighth intermediate gear 122, and a fifth belt 94.

The third planetary gear mechanism 120 includes: a sixth intermediate gear 92 mounted on a shaft 93; a sun gear 124 rotatable about and together with the shaft 93; a planetary gear 125 rotatable while revolving around the sun gear 124; and an arm 126. It is noted that a sun gear of the present invention is constituted by the sixth intermediate gear 92 and the sun gear 124, for example.

The second output gear 88 is in meshed engagement with a rear one of the fourth intermediate gears 89, that is, the second output gear 88 is coupled to the first transmitter 116. As will be described below, when the switch gear 51 is located at a first power transmission position, the second output gear 88 is meshed with the switch gear 51, so that the rotational driving power is transmitted from the first gear 78 to the second output gear 88 (see FIG. 6A). In the present embodiment, an even number of the fourth intermediate gears 89 (specifically, two fourth intermediate gears 89) are provided. A front one of the fourth intermediate gears 89 is disposed coaxially with a rear one of the two fifth intermediate gears 91.

The endless fourth belt 90 is looped over the two fifth intermediate gears 91. Specifically, the fourth belt 90 is disposed on the two fifth intermediate gears 91 and looped over two pulleys that are respectively rotated coaxially and together with the fifth intermediate gears 91.

A front one of the two fifth intermediate gears 91 is in meshed engagement with the sixth intermediate gear 92. That is, the sixth intermediate gear 92 is coupled to the first transmitter 116. The sixth intermediate gear 92 and the sun gear 124 of the third planetary gear mechanism 120 are rotated about and together with the shaft 93. The sun gear 124 has a thrust face on which one end of the arm 126 is mounted. Thus, the arm 126 is rotated about the shaft 93. The planetary gear 125 is rotatably supported on the other end of the arm 126. The planetary gear 125 is in meshed engagement with the sun gear 124. In the construction described above, the planetary gear 125 is rotated while supported by the arm 126 and is revolved around the sun gear 124 in a rotational direction of the sun gear 124 while meshed with the sun gear 124.

The seventh intermediate gear 121 of the second transmitter 117 is disposed at a position at which the seventh intermediate gear 121 can be meshed with or coupled to the planetary gear 125. The eighth intermediate gear 122 is in meshed engagement with the seventh intermediate gear 121. The endless fifth belt 94 is looped over the supply pulley 123 and the eighth intermediate gear 122 (specifically, a pulley disposed adjacent to the eighth intermediate gear 122 and rotatable coaxially and together with the eighth intermediate gear 122). Here, the supply rollers 25 and the supply pulley 123 are rotated coaxially and together with each other. Thus, the fifth belt 94 of the second transmitter 117 is connected to the supply pulley 123 and thereby coupled to the supply rollers 25.

There will be next explained power transmission of the supply power transmitter 29 with reference to FIG. 4. When the conveyor motor 71 is rotated in the reverse direction, each of the first conveyor roller 60 and the first gear 78 is rotated in the clockwise direction, i.e., the second rotational direction. When the first gear 78 is rotated in the clockwise direction, the switch gear 51 is rotated in the counterclockwise direction, the second output gear 88 is rotated in the clockwise direction, the fourth intermediate gears 89 are rotated in the counterclockwise direction, and the two fifth intermediate gears 91 are rotated in the clockwise direction.

When the fifth intermediate gears 91 are rotated in the clockwise direction, the sixth intermediate gear 92 and the sun gear 124 provided coaxially with the sixth intermediate gear 92 are rotated in the counterclockwise direction. When the sun gear 124 is rotated in the counterclockwise direction, i.e., in a direction indicated by arrow 127, the planetary gear 125 is revolved around the sun gear 124 in the direction indicated by arrow 127. As a result, the planetary gear 125 is connected to and meshed with the seventh intermediate gear 121. An amount of the reverse rotation of the conveyor motor 71 which is required for connecting the planetary gear 125 to the seventh intermediate gear 121 is a first rotational amount. When the planetary gear 125 and the seventh intermediate gear 121 are connected to and meshed with each other, the planetary gear 125 stops revolving and starts rotating. A direction of the rotation of the planetary gear 125 is the clockwise direction. Thus, when, the planetary gear 125 is rotated, the seventh intermediate gear 121 meshed with the planetary gear 125 is rotated in the counterclockwise direction.

When the seventh intermediate gear 121 is rotated in the counterclockwise direction, the eighth intermediate gear 122 and the supply pulley 123 are rotated in the clockwise direction. When the supply pulley 123 is rotated in the clockwise direction, the supply rollers 25 are also rotated in the clockwise direction, i.e., the second rotational direction. When the supply rollers 25 are rotated in the clockwise direction, i.e., the second rotational direction, the recording sheet 12 placed on the supply tray 20 and contacting the supply rollers 25, i.e., an uppermost one of the recording sheets 12 placed on the supply tray 20 is supplied toward the first conveyor roller 60.

On the other hand, when the conveyor motor 71 is rotated in the forward direction, the sun gear 124 is rotated in the clockwise direction, i.e., in a direction indicated by arrow 128 in contrast to the case where the conveyor motor 71 is rotated in the reverse direction. Thus, the planetary gear 125 is revolved around the sun gear 124 in the direction indicated by arrow 128. As a result, the planetary gear 125 is disconnected or moved away from the seventh intermediate gear 121. In view of the above, when the conveyor motor 71 is rotated in the forward direction, the rotational driving power is not transmitted from the conveyor motor 71 to the supply rollers 25, not causing the rotation of the supply rollers 25.

<Fifth Power Transmitter 59>

Figures 6A, 6B, 6C:
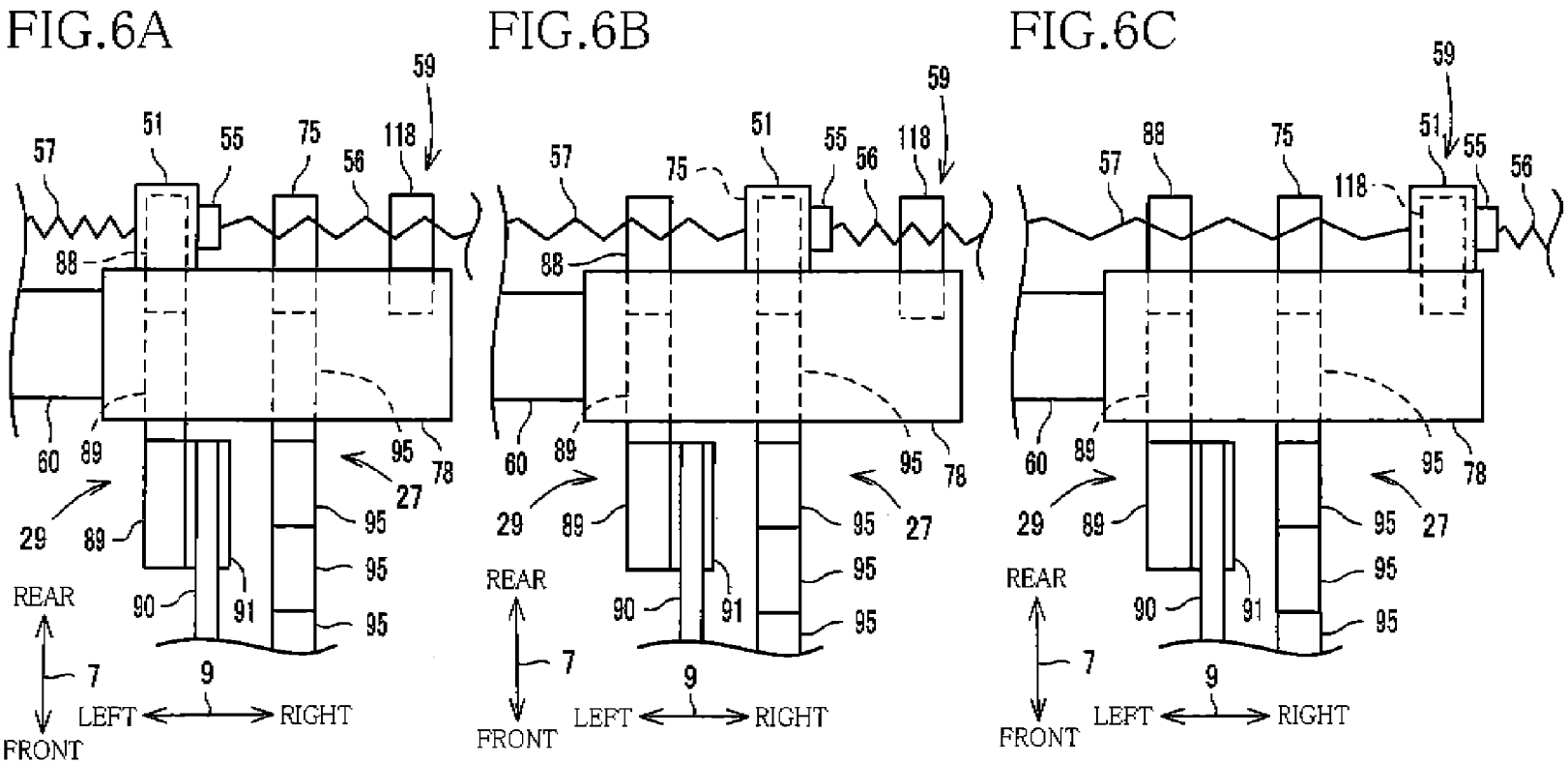
FIG. 6A is a plan view schematically illustrating meshing states of gears 51, 75, 78, 88, 118 with the switch gear 51 located at a first power transmission position.
FIG. 6B is a plan view schematically illustrating meshing states of gears 51, 75, 78, 88, 118 with the switch gear 51 located at a second power transmission position.
FIG. 6C is a plan view schematically illustrating meshing states of gears 51, 75, 78, 88, 118 with the switch gear 51 located at a third power transmission position.

As illustrated in FIG. 6C, the fifth power transmitter 59 includes a transmission gear 118 and a third transmitter, not shown, coupled to the transmission gear 118 and the pump 119. As will be described below, when the switch gear 51 is located at a third power transmission position, the transmission gear 118 is meshed with the switch gear 51, so that the rotational driving power is transmitted from the first gear 78 to the transmission gear 118 (see FIG. 6C). The third transmitter includes; a pulley that is rotated together with the transmission gear 118; a pulley that is rotated together with the roller of the pump 119; and a belt looped over these two pulleys. In view of the above, when the switch gear 51 is located at the third power transmission position, the rotational driving power is transmitted from the first gear 78 to the pump 119. It is noted that, in the present embodiment, the third transmitter includes a mechanism (specifically, a planetary gear mechanism) for switching transmission of the driving power of the first conveyor roller 60, and the third transmitter transmits only the reverse rotational driving power of the conveyor motor 71 to the pump 119.

<Switcher 30>

As illustrated in FIGS. 3, 4, and 6A-6C, the switcher 30 includes the switch gear 51, coil springs 56, 57, and a switch lever 55 as one example of a contact portion.

As illustrated in FIGS. 6A-6C, the switch gear 51 is in meshed engagement with the first gear 78. Thus, the switch gear 51 is rotated by the driving power transmitted from the conveyor motor 71. The switch gear 51 is movable in the right and left directions 9 at least to the first power transmission position indicated in FIG. 6A, the second power transmission position indicated in FIG. 6B, and the third power transmission position indicated in FIG. 6C in a state in which the switch gear 51 is meshed with the first gear 78. The first power transmission position is located on a left side of the second power transmission position. The third power transmission position is located on a right side of the second power transmission position. Each of the first-third power transmission positions is located on a right side of the first conveyance path 65.

As illustrated in FIG. 6A, when the switch gear 51 is located at the first power transmission position, the switch gear 51 is connected to (i.e., meshed with) the first gear 78 and the fourth intermediate gear 89. It is noted that the switch gear 51 is not meshed with the first output gear 75 and the transmission gear 118 in this state. As a result, the rotational driving power transmitted from the conveyor motor 71 to the switch gear 51 via the first gear 78 is transmitted to the supply power transmitter 29.

As illustrated in FIG. 6B, when the switch gear 51 is located at the second power transmission position, the switch gear 51 is connected to (i.e., meshed with) the first gear 78 and the first output gear 75. It is noted that the switch gear 51 is not meshed with the fourth intermediate gear 89 and the transmission gear 118 in this state. As a result, the rotational driving power transmitted from the conveyor motor 71 to the switch gear 51 via the first gear 78 is transmitted to the second power transmitter 27 and the fourth power transmitter 28.

As illustrated in FIG. 6C, when the switch gear 51 is located at the third power transmission position, the switch gear 51 is connected to (i.e., meshed with) the first gear 78 and the transmission gear 118. It is noted that the switch gear 51 is not meshed with the fourth intermediate gear 89 and the first output gear 75 in this state. As a result, the rotational driving power transmitted from the conveyor motor 71 to the switch gear 51 via the first gear 78 is transmitted to the fifth power transmitter 59.

As illustrated in FIGS. 6A-6C, a right face of the switch gear 51 is contactable with the switch lever 55. The carriage 40 is contactable with the switch lever 55 from the left side. Also, the switch lever 55 is provided with the coil spring 56. The switch lever 55 and the coil spring 56 are arranged along an axial direction of the switch gear 51. One end of the coil spring 56 is mounted on a right face of the switch lever 55, and the other end of the coil spring 56 is mounted on, e.g., the frame of the printing section 11, not shown. As a result, the switch lever 55 is urged by the coil spring 56 from a side nearer to the third power transmission position toward a side nearer to the first power transmission position, i.e., in the left direction. Also, the coil spring 57 is mounted on the switch gear 51 on an opposite side thereof from the coil spring 56. As a result, the switch gear 51 is urged by the coil spring 57 from the side nearer to the first power transmission position toward the side nearer to the third power transmission position, i.e., in the right direction. It is noted that an urging force of the coil spring 56 is greater than that of the coil spring 57. Therefore, the switch gear 51 and the switch lever 55 are urged from the side nearer to the third power transmission position toward the side nearer to the first power transmission position, i.e., in the left direction. Also, the coil springs 56, 57 cause the switch gear 51 and the switch lever 55 to move rightward or leftward in a state in which the switch gear 51 and the switch lever 55 are held in contact with each other.

A stopper, not shown, is provided at the first power transmission position, to stop the switch lever 55, and the switch gear 51 located at the first power transmission, position is inhibited by the stopper from being moved by the urging force of the coil spring 56 from the third power transmission position toward the first power transmission position, i.e., in the left direction. This keeps the switch gear 51 at the first power transmission position. When the switch gear 51 located at the first power transmission position is pushed by the carriage 40 so as to be moved rightward from the first power transmission position, the switch lever 55 is released from the stopper, and the switch gear is moved from the first power transmission position (see FIG. 6A) to the second power transmission position (see FIG. 6B). It is noted that the stopper is designed to stop the leftward movement of the switch lever 55 such that the switch gear 51 is positioned at one of the first-third power transmission positions, but also designed not to stop the rightward movement of the switch lever 55 such that the switch gear 51 is positioned at one of the first-third power transmission positions.

A stopper, not shown, having a construction similar to that of the stopper provided at the first power transmission position is provided at the second power transmission position to stop the switch lever 55, and as in the case of the switch gear 51 located at the first power transmission position, the movement of the switch gear 51 located at the second power transmission position is inhibited by the stopper, not shown, and the urging force of the coil spring 56 which urges the switch lever 55 toward the first power transmission position, i.e., in the left direction. This keeps the switch gear 51 at the second power transmission position. When the switch gear 51 located at the second power transmission position is pushed by the carriage 40 so as to be moved rightward from the second power transmission position, the switch lever 55 is released from the stopper, and the switch gear 51 is moved from the second power transmission position (see FIG. 6B) to the third power transmission position (see FIG. 6C).

When the switch gear 51 located at the third power transmission position is pushed by the carriage 40 so as to be moved rightward from the third power transmission position, the switch lever 55 is released from the stopper. When the carriage 40 is moved leftward in this state, the switch lever 55, i.e., the switch gear 51 is moved by the urging force of the coil spring 56 from the third power transmission position to the first power transmission position.

In view of the above, the switcher 30 switches a destination of the power transmission from the first conveyor roller 60, selectively to the second power transmitter 27 and the fourth power transmitter 28, the supply power transmitter 29, or the fifth power transmitter 59.

Specifically, when the switch gear 51 is located at the first power transmission position, the switcher 30 transmits the driving power from the conveyor motor 71 to the supply power transmitter 29 via the first conveyor roller 60. Also, when the switch gear 51 is located at the second power transmission position, the switcher 30 transmits the driving power from the conveyor motor 71 to the second power transmitter 27 and the fourth power transmitter 28 via the first conveyor roller 60. Also, when the switch gear 51 is located at the third power transmission position, the switcher 30 transmits the driving power from the conveyor motor 71 to the fifth power transmitter 59 via the first conveyor roller 60. It is noted that, when the switch gear 51 is located at the second power transmission position or the third power transmission position, the switcher 30 does not transmit the driving power from the conveyor motor 71 to the supply power transmitter 29 via the first conveyor roller 60.

The state in which the switch gear 51 is located at the first power transmission position is one example of a first power transmission state. The state in which the switch gear 51 is located at the second power transmission position or the third power transmission position is one example of a second power transmission state. That is, the state of the switcher 30 is switched between the first power transmission state in which the switcher 30 transmits the driving power from the conveyor motor 71, to the supply power transmitter 29 and the second power transmission state in which the switcher 30 does not transmit the driving power from the conveyor motor 71, to the supply power transmitter 29.

Also, in view of the above-described explanation, the contact of the carriage 40 with the switch lever 55 moves the switch gear 51 selectively to one of the first power transmission position at which the switch gear 51 is meshed with the second output gear 88 to cause the switcher 30 to be in the first power transmission state; and the second power transmission position or the third power transmission position at which the switch gear 51 is not meshed with the second output gear 88 to cause the switcher 30 to be in the second power transmission state. That is, the first power transmission position is one example of a transmission area, and each of the second power transmission position and the third power transmission position is one example of a non-transmission area.

Also, in the present embodiment, when the switch gear 51 is moved between the first power transmission position and the third power transmission position by the pushing contact of the carriage 40 with the switch lever 55, the state of the cap 171 is switched between the separated state and the capping state. This switching of the state of the cap 171 is made by the carriage 40 which pushes or comes off the lever 177. That is the lever 177 switches the cap 171 from the separated state to the capping state in conjunction with the movement of the switcher 30 from the first power transmission position to the third power transmission position. On the other hand, the lever 177 switches the cap 171 from the capping state to the separated state in conjunction with the movement of the switcher 30 from the third power transmission position to the first power transmission position. That is, the third power transmission position is one example of a capping position within the non-transmission area.

Also, the controller 130 controls the carriage 40 to be moved and brought into contact with the switch lever 55 to move the switch gear 51 selectively to one of the first-third power transmission positions. That is, the controller 130 controls the switcher 30 to be moved to the third power transmission position, whereby the switcher 30 is switched to the second power transmission state, i.e., a state in which the driving power is not transmitted from the conveyor motor 71 to the supply power transmitter 29.

<Forward and Reverse Rotations of Switch Gear 51 for Gear Switching>

In the construction as described above, teeth of gears are sometimes not aligned when the switch gear 51 is disengaged from the second output gear 88 and meshed with the first output gear 75 by the movement of the switcher 30 from the first power transmission position to the second power transmission position, or when the switch gear 51 is disengaged from the second output gear 88 and meshed with the transmission gear 118 by the movement of the switcher 30 from the first power transmission position to the third power transmission position, or when the switch gear 51 is disengaged from the first output gear 75 and meshed with the transmission gear 118 by the movement of the switcher 30 from the second power transmission position to the third power transmission position, or when the switch gear 51 is disengaged from the transmission gear 118 and meshed with the second output gear 88 by the movement of the switcher 30 from the third power transmission position to the first power transmission position. Specifically, a tooth of one of the gears may not enter into a position between teeth of the other of the gears, that is, thrust faces of the teeth of the other gear inhibits movement of the tooth of the one gear. In this case, the switch gear 51 may not be engaged with the gear 75, 88, or 118. That is, switching of the switch gear 51 may not be performed appropriately.

To solve this problem, in the present embodiment, after the switch gear 51 is moved, for example, after the switch gear 51 is moved from the second power transmission position or the third power transmission position to the first power transmission position, the controller 130 controls the conveyor motor 71 to make a forward rotation and a reverse rotation alternately a predefined number of times (noted that the forward rotation and the reverse rotation may be hereinafter referred to as "forward and reverse rotation"). As a result, a forward rotation and a reverse rotation of the switch gear 51 are made alternately the predefined number of times. Here, the predefined number of times is a design value that is a number of times of forward and reverse rotations of the switch gear 51 which ensures reliable switching of the gears. In each of the forward rotation and the reverse rotation, the conveyor motor 71 is rotated by a second rotational amount that is smaller than a rotational amount of the conveyor motor 71 for causing one rotation of the switch gear 51. Also, in the present embodiment, the second rotational amount is equal to or larger than a rotational amount that corresponds to a space between the teeth of the switch gear 51 and the gear 75, 88, or 118. Furthermore, in the present embodiment, the second rotational amount is smaller than the above-described first rotational amount, i.e., the amount of the reverse rotation of the conveyor motor 71 which is required for connecting the planetary gear 125 to the seventh intermediate gear 121.

As thus described, the controller 130 controls the conveyor motor 71 to make its alternate forward and reverse rotation the predefined number of times, whereby the switch gear 51 is rotated in its forward direction and its reverse direction alternately. As a result, the teeth of the gears are aligned so as to be meshable with each other; ensuring smooth and reliable switching of the gears.

<Controller 130>

The controller 130 illustrated in FIG. 8 controls overall operations of the MFP 10. For example, the controller 130 controls the conveyor motor 71. The controller 130 also controls the carriage drive motor 53 to move the carriage 40 in order to control the switcher 30 to switch the transmission of the driving power. As illustrated in FIG. 8, the controller 130 includes a CPU 131, a ROM 132, a RAM 133, an EEPROM 134, an ASIC 135, and an internal bus 137 for connecting these devices to one another.

The ROM 132 stores various programs and data for the CPU 131 to control various operations. The RAM 133 is used as a storage area for temporarily storing, e.g., data and signals used when the CPU 131 executes the programs. It is noted that the RAM 133 has an area for storing a nip flag which will be described below. The EEPROM 134 is for storing settings, flags, and other similar data which should be kept after the MFP 10 is turned off.

Connected to the ASIC 135 are the conveyor motor 71 and the carriage drive motor 53. When, a drive signal for rotating each motor is input from the CPU 131 to a corresponding drive circuit, a drive current related to the drive signal is output from the drive circuit to the motor, causing the motor to be rotated forwardly or reversely at a predetermined rotational, speed.

Also, a pulse signal output from the optical sensor 72 of the rotary encoder 73 is input to the ASIC 135. On the basis of this pulse signal transmitted from the optical sensor 72, the controller 130 detects rotational amounts of the conveyor rollers 60, 62, 45.

Also, the optical sensor 163 of the sensor 160 is connected to the ASIC 135. On the basis of a signal transmitted from the optical sensor 163, the controller 130 detects the downstream edge and the upstream edge of the recording sheet 12 in the first direction 15 at the position of the sensor 160.

Also, the media sensor 150 is connected to the ASIC 135. When an electric signal of a predetermined level is input from the ASIC 135 to the media sensor 150, the light emitting portion 151 emits light downward by an amount related to the predetermined level. When its reflected light is received by the light receiving portion 152, the media sensor 150 sends the controller 130 an electric signal that corresponds to a level related to an amount of the received reflected light. The amount of the received reflected light is larger in the case where the fight emitted from the fight emitting portion 151 is reflected off the recording sheet 12 than in the case where the light is reflected off the platen 42. This is because the recording sheet 12 has a lighter color than the platen 42 and easily reflects light. When the level of the electric signal transmitted from the media sensor 150 is larger than a predefined threshold value, the controller 130 determines that the recording sheet 12 is supported on the platen 42. On the other hand, when the level of the electric signal transmitted from the media sensor 150 is equal to or smaller than the threshold value, the controller 130 determines that the recording sheet 12 is not supported on the platen 42.

<Controls of Controller 130>

There will be next explained, with reference to the flow charts in FIGS. 9A-11, a procedure or flow of processings executed by the controller 130 for image recording on the recording sheet 12. While a procedure of processings executed by the controller 130 for simplex image recording on the recording sheet 12 will be explained, it is to be understood that the controller 130 may execute duplex image recording on the recording sheet 12. It is noted that an initial position of the switch gear 51 is the third power transmission, position in the flow charts in FIGS. 9A-11.

When a main power of the MFP 10 is turned on by a user, the controller 130 waits for input of a print command (S10: No). Here, the print command is a command for recording an image on the recording sheet 12, and the print command is constituted by print data regarding an image to be recorded on the recording sheet 12, the number of recording sheets 12 to be printed, a size of the recording sheets 12, and a tray used for supply of the recording sheets 12 (specifically, the supply tray 20 or the manual tray 22), for example. The print command is input to the controller 130 from an operation portion 17 (see FIG. 1) constituted by a panel and keys. Alternatively, the print command is input from an external device coupled to the MFP 10 to an interface portion of the MFP 10 and output from the interface portion to the controller 130. The operation portion 17 and the interface portion are one example of a command output portion.

When the print command is received by the controller 130 (S10: Yes), the controller 130 at S20 determines whether or not the print command contains information indicating that the recording sheet 12 for the image recording is to be supplied from the manual tray 22. In other words, the controller 130 determines whether or not the print command contains information indicating that the image recording is to be performed on the recording sheet 12 placed on the manual tray 22 (hereinafter may be referred to as "manual-tray information"). When, the print command contains the manual-tray information (S20: Yes), the controller 130 at S25 determines whether the switcher 30 is in the first power transmission state or not, that is, the controller 130 determines whether the switch gear 51 is located at the first power transmission position or not. When the print command does not contain the manual-tray information (S20: No), this flow goes to S400 which will be described below.

Here, examples of a method of determining which power transmission position the switch gear 51 is located at include a method using flags as will be described below. A first flag and a second flag are stored in the RAM 133, and each of the first flag and the second flag is set at "0" when the MFP 10 is turned on (noted that the switch gear 51 is located at the third power transmission position as the initial position in this state). When the carriage 40 is moved leftward and comes off the switch lever 55, and the switch gear 51 is moved to the first power transmission position, the controller 130 sets the first flag to "1". When the carriage 40 is moved rightward while pushing the switch lever 55, and the switch gear 51 is moved to the second power transmission position, the controller 130 sets the second flag to "1". When the carriage 40 is further moved rightward while pushing the switch lever 55, and the switch gear 51 is moved to the third power transmission position, the controller 130 resets the first flag and the second flag. With these controls, the controller 130 can determine the power transmission position of the switch gear 51. It is noted that the controller 130 determines whether the switch gear 51 has reached any of the power transmission positions or not, on the basis of the number of pulse signals produced by a well-known linear encoder. This linear encoder produces a pulse signal in response to the movement of the carriage 40 in the right and left directions 9. Also, another example of the method of determining which power transmission position the switch gear 51 is located at is a method using sensors for sensing the position of the switch gear 51 or the switch lever 55.

When the switch gear 51 is located at the first power transmission position (S25: Yes), the controller 130 moves the switch gear 51 from the first power transmission position to the third power transmission position. That is, when the switcher 30 is in the first power transmission state, the controller 130 at S30 switches the switcher 30 from the first power transmission state to the second power transmission state. The processing at S30 is one example of a switching control. It is noted that, since the switch gear 51 is located at the third power transmission position just after the MFP 10 is turned on (S25: No), this flow goes to S40 which will be described below in this case without going to S30.

Here, there will be explained the case where the switch gear 51 is located at the first power transmission position at S25. When the MFP 10 is turned on, the switch gear 51 is located at the third power transmission position in order to suppress drying of the nozzle face 43 of the recording head 38. When the controller 130 then receives the print command and completes a print job of the simplex image recording (e.g., in a case of a negative decision at S130 or S490 which will be described below), the controller 130 controls the carriage drive motor 53 to stop the carriage 40 over the platen 42 for a speedy start of a subsequent job. It is noted that, when a set specific length of time (e.g., ten seconds) has passed, the carriage 40 stopped over the platen 42 is controlled by the controller 130 to move the switch gear 51 to the third power transmission position. As a result, the nozzle face 43 of the recording head 38 is covered with the cap 171. Accordingly, in a case where the print command for the subsequent job has been received by the controller 130 within the set specific length of time, the switch gear 51 is located at the first power transmission position.

At S40, the controller 130 determines whether the recording sheet 12 is placed on the manual tray 22 or not. In other words, the controller 130 determines whether the user has set the recording sheet 12 on the manual tray 22 or not. Here, the controller 130 determines that the recording sheet 12 is set on the manual tray 22 or not, on condition that the level of the signal output from the optical sensor 163 of the sensor 160 has been switched from the low level to the high level. Alternatively, the controller 130 may determine that the recording sheet 12 is set on the manual tray 22 when the level of the signal output from the optical sensor 163 is the high level. It is noted that, in the present embodiment, the controller 130 waits for the recording sheet 12 to be set on the manual tray 22 (S40: No).

When the controller 130 determines that the recording sheet 12 is set on the manual tray 22 (S40: Yes), the controller 130 at S50 rotates the conveyor motor 71 in the reverse direction to rotate the first conveyor roller 60 in the second rotational direction by a set specific amount. This rotation establishes a state in which the downstream edge of the recording sheet 12 set on the manual tray 22 in the first direction 15 is held in contact with the first conveyor roller 60 rotating in the second rotational direction. As a result, an oblique state (i.e., oblique conveyance) of the recording sheet 12 set on the manual tray 22 is corrected. The processing at S50 is one example of a reverse-rotation control. Then at S55, the controller 130 rotates the conveyor motor 71 in the forward direction to rotate the first conveyor roller 60 in the first rotational direction. As a result, the recording sheet 12 is nipped between the first conveyor roller 60 and the pinch rollers 61.

At S60, the controller 130 drives the carriage drive motor 53 to move the carriage 40 to a sheet-size detection position. Here, the sheet-size detection position is a position at which the media sensor 150 is opposed to the recording sheet 12 supported on the platen 42. In addition, the sheet-size detection position is a position within an area on which a recording sheet 12 of a first size contained in the print command is conveyed but a recording sheet 12 of a second size smaller than the first size is not conveyed, for example. The detection of the sheet size at this position allows speedy prevention of image recording on a recording sheet 12 that is smaller than the recording sheet 12 having the size contained in the print command. Also, the movement of the carriage 40 to the sheet-size detection position at S60 moves the switch gear 51 from the third power transmission position to the first power transmission position.

The controller 130 then rotates the conveyor motor 71 in the forward direction. As a result, the first conveyor roller 60 is rotated in the first rotational direction to convey the recording sheet 12 in the first direction 15. The controller 130 at S70 rotates the first conveyor roller 60 so as to convey the recording sheet 12 to the position at which the recording sheet 12 is opposed to the media sensor 150.

The controller 130 at S80 determines whether or not there is a recording sheet 12 at the position opposed to the media sensor 150, i.e., the sheet-size detection position, on the basis of the electric signal output from the media sensor 150 based on the reflected light received by the light receiving portion 152 of the media sensor 150. When there is a recording sheet 12 at the sheet-size detection position, that is, a recording sheet 12 is sensed (S80: Yes), the controller 130 at S90 rotates the conveyor motor 71 in the forward direction to rotate the first conveyor roller 60 so as to convey the recording sheet 12 to a print starting position. Here, the print starting position is a position at which a downstream edge of an image recording area on the recording sheet 12 in the first direction 15 is opposed to a most downstream one of the nozzles of the recording head 38 in the first direction 15, for example. The controller 130 then controls the recording head 38 to eject the ink droplets from the nozzle face 43 onto the recording sheet 12. That is, until the image recording on the recording sheet 12 is completed (S110: No), the controller 130 at S90 rotates the first conveyor roller 60 to intermittently convey the recording sheet 12 and at S100 controls the recording head 38 to eject the ink droplets from the nozzle face 43 onto the recording sheet 12 during each stop of the recording sheet 12 in the intermittent conveyance.

It is noted that when the recording sheet 12 is not sensed at S80 (S80: No), this flow goes to S200 which will be described below.

When the image recording on the recording sheet 12 is completed (S110: Yes), the controller 130 at S120 rotates the conveyor motor 71 in the forward direction to rotate the second conveyor rollers 62 and the third conveyor rollers 45 so as to convey the recording sheet 12 onto the output tray 21. That is, the controller 130 executes a processing for discharging the recording sheet 12.

The controller 130 at S130 determines whether or not there is a remaining page or pages to be printed, on the basis of the print command received at S10. When there are no remaining pages (S130: No), this flow ends. On the other hand, when there is a remaining page or pages (S130: Yes), this flow goes to S310 which will be described below.

When the controller 130 at S20 determines that the print command does not contain the manual-tray information (S20: No), the controller 130 rotates the conveyor motor 71 in the reverse direction. When the switch gear 51 is in the third power transmission position as the initial state in this rotation, the controller 130 drives the carriage drive motor 53 to move the switch gear 51 to the first power transmission position, that is, to switch the switcher 30 to the first power transmission state. Thus, when the conveyor motor 71 is rotated in the reverse direction with the switch gear 51 being in the first power transmission state, the supply rollers 25 are rotated (S400). That is, the recording sheet 12 placed on the supply tray 20 is supplied to the first conveyance path 65 by the supply rollers 25.

The controller 130 at S410 determines whether the signal output from the optical sensor 163 of the sensor 160 is switched within a predefined length of time or not. Specifically, the controller 130 determines whether or not the level of the signal output from the optical sensor 163 is switched from the low level to the high level within the predefined length of time from the rotation of the supply rollers 25. In other words, the controller 130 determines whether the recording sheet 12 is appropriately supplied from the supply tray 20 or not. It is noted that the predefined length of time may be a time starting from a start of the reverse rotation of the conveyor motor 71 at S400, for example.

When the level of the signal output from the optical sensor 163 is switched from the low level to the high level within the predefined length of time (S410: Yes), the controller 130 at S420 moves the carriage 40 to the sheet-size detection position and at S430 controls the first conveyor roller 60 to convey the recording sheet 12 to the position opposed to the media sensor 150. It is noted that when the level of the signal output from the optical sensor 163 is not switched from the low level to the high level within the predefined length of time (S410: No), this flow goes to S600 which will be described below.

The controller 130 at S440 determines whether or not there is a recording sheet 12 at the position opposed to the media sensor 150, i.e., the sheet-size detection position, on the basis of the electric signal output from the media sensor 150 based on the reflected light received by the light receiving portion 152 of the media sensor 150. When there is a recording sheet 12 at the sheet-size detection position, that is, a recording sheet 12 is sensed (S440: Yes), the controller 130 at S450-S490 executes the same processings as executed in S90-S130, that is, the controller 130 executes the printing on the recording sheet 12 and the discharging of the recording sheet 12. However, when the controller 130 at S490 determines that there is a remaining page or pages (S490: Yes), this flow returns to S400 without going to S310 which will be described below. It is noted that when the controller 130 determines that there is no recording sheet 12 at the sheet-size detection position, that is, a recording sheet 12 is not sensed (S440: No), this flow goes to S690 which will be described below. It is noted that the controller 130 makes the negative decision at S440 in a case where the supplied recording sheet 12 is smaller in size than the recording sheet 12 having the size contained in the print command. In this case, the controller 130 executes processings at S690 and S700 in order to prevent the platen 42 from being soiled with ink droplets ejected from the recording head 38.

When the controller 130 at S410 determines that the level of the signal output from the optical sensor 163 is not switched from the low level to the high level within the predefined length of time (S410: No), the controller 130 at S600 stops the supply rollers 25 and controls the panel of the operation portion 17 to display a message saying "SHEET SUPPLY ERROR: PRESS START BUTTON AFTER RESETTING SHEET". Here, the start button is one of the keys provided on the operation portion 17. In response to the pressing of the start button, the controller 130 controls the MFP 10 to restart a suspended operation (S650: Yes, which will be described below).

Subsequent to S600, the controller 130 at S605 clears the nip flag stored in the RAM 133, that is, the controller 130 sets the nip flag to "0". As in the processing at S40, the controller 130 at S610 determines whether the recording sheet 12 is set on the manual tray 22 or not. When the recording sheet 12 is set on the manual tray 22 (S610: Yes), the controller 130 at S615 determines whether the switcher 30 is in the first power transmission state or not, that is, the controller 130 determines whether the switch gear 51 is located at the first power transmission position or not. When the switch gear 51 is located at the first power transmission position (S615: Yes), the controller 130 at S620 switches the switcher 30 from the first power transmission state to the second power transmission state as in the processing at S30. The processing at S620 is one example of the switching control. It is noted that, when the controller 130 at S615 determines that the switch gear 51 is located at the third power transmission position, that is, when the switcher 30 is not in the first power transmission state (S615: No), this flow skips 5620.

At S625, the controller 130 determines whether the nip flag stored in the RAM 133 is "1" or not. When the nip flag is not "1", that is, the nip flag is "0" (S625: No), this flow goes to S630 at which the controller 130 as in the processing at S50 rotates the first conveyor roller 60 in the second rotational direction by the set specific amount to correct the oblique state of the recording sheet 12 set on the manual tray 22. The processing at S630 is one example of the reverse-rotation control. In view of the above, the controller 130 executes the switching control and thereafter executes the reverse-rotation control on, conditions that the supply rollers 25 are not rotated and that the level of the signal output from the optical sensor 163 of the sensor 160 has been switched from the low level to the high level. It is noted that the state in which the nip flag is "0" is a state in which the recording sheet 12 placed on the manual tray 22 is not nipped between the first conveyor roller 60 and the pinch rollers 61.

At S640, the controller 130 rotates the conveyor motor 71 in the forward direction to rotate the first conveyor roller 60 in the first rotational direction by a set specific amount. As a result, the recording sheet 12 set on the manual tray 22 is nipped between the first conveyor roller 60 and the pinch rollers 61. This prevents the recording sheet 12 set on the manual tray 22 from dropping from the manual tray 22. At S642 the controller 130 sets the nip flag to "1" and this flow goes to S650. The state in which the nip flag is "1" is a state in which the recording sheet 12 placed on the manual tray 22 is nipped between the first conveyor roller 60 and the pinch rollers 61. On the other hand, when the controller 130 at S625 determines that the nip flag is "1", this flow skips S630-S642 and goes to S650. This is because the recording sheet 12 placed on the manual tray 22 has already been nipped between the first conveyor roller 60 and the pinch rollers 61.

On the other hand, when the controller 130 at S610 determines that the recording sheet 12 is not set on the manual tray 22 (S610: No), the controller 130 at S644 clears the nip flag, and this flow goes to S650.

The controller 130 at S650 determines whether the start button is pressed or not. It is noted that the message displayed on the panel of the operation portion 17 at S600 or S700 which will be described below continues to be displayed until the start button is pressed (S650: Yes). It is noted that when the start button is not pressed (S650: No), this processing returns to S610. When the user presses the start button after setting the recording sheet 12 on the manual tray 22 or the supply tray 20 (S650: Yes), the controller 130 at S660 determines whether the level of the signal output from the optical sensor 163 is the high level or not. When the signal output from the optical sensor 163 is the high level (S660: Yes), the recording sheet 12 is set on the manual tray 22, and this flow returns to S60. On the other hand, when the signal output from the optical sensor 163 is the low level (S660: No), the recording sheet 12 is set on the supply tray 20, and the controller 130 executes the above-described processings at S400 and subsequent steps.

When the controller 130 determines that there is no recording sheet 12 at the sheet-size detection position, that is, a recording sheet 12 is not sensed (S440: No), the controller 130 at S690 stops the supply rollers 25 and, as in the processing at S120, rotates the conveyor motor 71 in the forward direction to rotate the first conveyor roller 60, the second conveyor rollers 62, and the third conveyor rollers 45 so as to convey the recording sheet 12 onto the output tray 21. The controller 130 at S700 controls the panel of the operation portion 17 to display a message saying "SHEET SWF ERROR: PRESS START BUTTON AFTER RESETTING SHEET". Upon completion of the processing at S700, the controller 130 at S605 clears the nip flag and executes the processings at S610 and subsequent steps.

When the controller 130 at S80 determines that the recording sheet 12 is not sensed (S80: No), the controller 130 at S200 moves the carriage 40 to a sheet presence/absence detection position. The sheet presence/absence detection position is a position through which a recording sheet 12 of any size available in the MFP 10 passes. In a case where the MFP 10 employs what is called a center registration type in which the recording sheet 12 is conveyed in a state in which a center of the recording sheet 12 in the right and left directions 9 and a center of the platen 42 in the right and left directions 9 are aligned to each other, the sheet presence/absence detection position is the center of the platen 42 in the right and left directions 9. In a case where the MFP 10 employs what is called a side registration type in which the recording sheet 12 is conveyed in a state in which one edge of the recording sheet 12 in the right and left directions 9 and one edge of the platen 42 in the right and left directions 9 are aligned to each other, the sheet presence/absence detection position is one end portion of the platen 42 in the right and left directions 9.

At S210, the controller 130 determines whether or not there is a recording sheet 12 at the sheet presence/absence detection position. When the controller determines that there is a recording sheet 12, that is, the recording sheet 12 is sensed (S210: Yes), the controller 130 at S212 controls the panel of the operation portion 17 to display a message saying "SHEET SIZE ERROR: PRESS START BUTTON AFTER RESETTING SHEET". In this case, the recording sheet 12 set on the manual tray 22 is a recording sheet 12 smaller in size than the recording sheet 12 having the size contained in the print command. Thus, the controller 130 rotates the conveyor motor 71 in the forward direction to rotate the first conveyor roller 60, the second conveyor rollers 62, and the third conveyor rollers 45 so as to convey the recording sheet 12 onto the output tray 21.

On the other hand, when the controller 130 determines that there is no recording sheet 12, that is, the recording sheet 12 is not sensed (S210: No), the controller 130 at S214 controls the panel of the operation portion 17 to display a message saying "PRESS START BUTTON AFTER RESETTING SHEET CORRECTLY". It is noted that, in this case, there is no recording sheet 12 at the position opposed to the media sensor 150 located at the sheet presence/absence detection position, that is, the recording sheet 12 is not nipped between the first conveyor roller 60 and the pinch rollers 61.

After the controller 130 controls the panel of the operation portion 17 to display the message at S212 or S214, the controller 130 at S220 switches the switcher 30 from the first power transmission state to the second power transmission state as in the processing at S30. The processing at S220 is one example of the switching control. As in the processing at S40, the controller 130 at S230 determines whether the recording sheet 12 is set on the manual tray 22 or not. The above-described message continues to be displayed until the recording sheet 12 is set on the manual tray 22 (S230: No). That is, the controller 130 waits for the user to set or place the recording sheet 12 on the manual tray 22. It is noted that when the controller 130 at S200 moves the carriage 40 to the sheet presence/absence detection position, the switch gear 51 may move to the first power transmission position.

When the recording sheet 12 is set on the manual tray 22 (S230: Yes), the controller 130 at S240 rotates the first conveyor roller 60 in the second rotational direction by the set specific amount to correct the oblique state of the recording sheet 12 set on the manual tray 22 as in the processing at S50. The processing at S240 is one example of the reverse-rotation control.

As in the processing at S640, the controller 130 at S250 rotates the conveyor motor 71 in the forward direction to rotate the first conveyor roller 60 in the first rotational direction by the set specific amount to prevent the recording sheet 12 set on the manual tray 22 from dropping from the manual tray 22.

Thereafter, in response to the pressing on the start button (S260), the controller 130 executes the above-described processings at S60 and subsequent steps.

When the controller 130 at S130 determines that there is a remaining page or pages (S130: Yes), the controller 130 at S310 switches the switcher 30 from the first power transmission state to the second power transmission state as in the processing at S30 in a case where the switcher 30 is in the first power transmission state. The processing at S310 is one example of the switching control.

The controller 130 at S320 controls the panel of the operation portion 17 to display a message saying "PRESS START BUTTON AFTER SETTING NEXT SHEET ON MANUAL TRAY". Thereafter, the controller 130 at S330-S360 executes processings similar to the above-described processings at S230-S260. The processing at S340 is one example of the reverse-rotation control.

<Effects>

In the present embodiment, when an image is to be recorded by the recording portion 24 on the recording sheet 12 placed on the manual tray 22, the driving power is not transmitted from the conveyor motor 71 to the supply rollers 25, so that the supply rollers 25 are not rotated. As a result, it is possible to prevent the recording sheet 12 placed on the supply tray 20 from being supplied in the reverse-rotation control for correcting the oblique state of the recording sheet 12 placed on the manual tray 22.

Also, when the recording sheet 12 placed on the supply tray 20 is supplied to the first conveyor roller 60 by the supply rollers 25, the optical sensor 163 of the sensor 160 outputs the high-level signal. That is, when the high-level signal is output from the optical sensor 163, the supply rollers 25 are being rotated. Also when the recording sheet 12 placed on the manual tray 22 is held in contact with the first conveyor roller 60, the optical sensor 163 outputs the high-level signal. In this case, the supply rollers 25 are not being rotated. That is, when the high-level signal is output from the optical sensor 163, the supply rollers 25 are not being rotated.

In the present embodiment, the controller 130 executes the switching control and the reverse-rotation control on conditions that the supply rollers 25 are not being rotated and that the level of the signal output from the optical sensor 163 has been switched from the low level to the high level. In view of the above, in the present embodiment, the controller 130 can accurately determine whether an image is to be recorded by the recording portion 24 on the recording sheet 12 placed on the manual tray 22 or not.

Also, in the present embodiment, when the print command contains the information indicating that the image recording is to be performed on the recording sheet 12 placed on the manual tray 22, the controller 130 executes the switching control without waiting for the high-level signal output from the optical sensor 163. Thus, in the present embodiment, the reverse-rotation control can be executed early when compared with a case in which the controller 130 executes the switching control after receiving the high-level signal output from the optical sensor 163.

Also, in the present embodiment, the switcher 30 is pushed by the carriage 40 to move between the transmission area and the non-transmission area. Thus, in the present embodiment, the transmission of the driving power can be switched by the switcher 30 without a need to provide a drive source specific to the switcher 30.

Also, in the present embodiment, the nozzle face 43 of the recording head 38 is covered with the cap 171 until the reverse-rotation control is completed. This makes it possible to suppress the drying of the nozzle face 43, resulting in a satisfactory image recorded on the recording sheet 12.

Also, in the present embodiment, the movement of the switch gear 51 switches between the presence and absence of the power transmission from the conveyor motor 71 to the supply power transmitter 29. That is, the present embodiment is preferable to realize the function of the switcher 30.

Also, in the present embodiment, the forward rotation and the reverse rotation of the conveyor motor 71 are alternately performed on condition that the switch gear 51 has been moved from the non-transmission area to the transmission area. As a result, when the switch gear 51 is moved from the non-transmission area to the transmission area, the switch gear 51 and the second output gear 88 can be reliably meshed with each other.

Also, in the present embodiment, when the forward rotation and the reverse rotation of the conveyor motor 71 are alternately performed, the rotational amount of the conveyor motor 71 in each of the forward rotation and reverse rotation is the second rotational amount that is smaller than the first rotational amount required for the planetary gear 125 to be connected to the second transmitter 117. Thus, it is possible to prevent the supply rollers 25 from being erroneously rotated by the reverse rotation of the conveyor motor 71 in its alternate forward and reverse rotations. This makes it possible to prevent an erroneous change in a position of the recording sheet 12 placed on the supply tray 20.

<Modification of Embodiment>

While the controller 130 moves the switch gear 51 from the first power transmission position to the third power transmission position in the switching control at S30, S220, S310, or S620 in the above-described embodiment, the controller 130 may move the switch gear 51 from the first power transmission position to the second power transmission, position, That is, the controller 130 only needs to move the switch gear 51 from the transmission area to the non-transmission area in the switching control.

While the switch gear 51 is selectively moved to one of the first-third power transmission positions in the above-described embodiment, a position to which the switch gear 51 is moved is not limited to these positions. For example, in a case where two supply trays 20 (namely, a first supply tray and a second supply tray) are provided in the MFP 10, the supply power transmitter 29 is constituted by a first supply power transmitter for transmitting the driving power to the first supply tray and a second supply power transmitter for transmitting the driving power to the second supply tray. Also, the switch gear 51 may be configured to transmit the driving power to the first supply power transmitter by moving to the first power transmission position and configured to transmit the driving power to the second supply power transmitter by moving to a fourth power transmission position located between the first power transmission position and the second power transmission position. In this case, the fourth power transmission position is located within the non-transmission area.

What is claimed is:

1. An image recording apparatus, comprising:

a supply tray configured to support a sheet;

a supply roller rotatable to supply the sheet supported by the supply tray to a conveyance path;

a conveyor roller rotatable to convey, in a conveying direction, the sheet supplied by the supply roller to the conveyance path;

a manual tray configured to support a sheet that is to be supplied to a manual-tray path merged with the conveyance path at a position located upstream of the conveyor roller in the conveying direction;

a recording device disposed downstream of the conveyor roller in the conveying direction and configured to record an image on the sheet;

a motor rotatable to produce a driving power, wherein the motor is configured to produce a forward rotational driving power when the motor rotates forwardly and produce a reverse rotational driving power when the motor rotates reversely;

a supply driving power transmitter configured not to transmit the forward rotational driving power to the supply roller and configured to transmit the reverse rotational driving power to the supply roller to cause the supply roller to supply the sheet supported by the supply tray;

a conveyance driving power transmitter configured to transmit the forward rotational driving power to the conveyor roller to cause the conveyor roller to rotate in a first rotational direction to convey the sheet in the conveying direction, the conveyance driving power transmitter being configured to transmit the reverse rotational driving power to the conveyor roller to cause the conveyor roller to rotate in a second rotational direction that is reverse to the first rotational direction;

a switcher configured to switch between a first power transmission state in which the driving power is transmitted from the motor to the supply driving power transmitter and a second power transmission state in which the driving power is not transmitted from the motor to the supply driving power transmitter; and a controller configured to, when an image is to be recorded on the sheet supported by the manual tray by the recording device and when the switcher is in the first power transmission state, execute a switching control for switching the switcher from the first power transmission state to the second power transmission state and thereafter execute a reverse-rotation control for causing the motor to rotate reversely to rotate the conveyor roller in the second rotational direction.

2. The image recording apparatus according to claim 1, wherein the controller is configured to, when an image is to be recorded on the sheet supported by the manual tray by the recording device and when the switcher is in the first power transmission state, execute the switching control regardless of whether the sheet is supported by the manual tray or not.

3. The image recording apparatus according to claim 1, wherein the controller is configured to when an image is to be recorded on the sheet supported by the manual tray by the recording device and when the switcher is in the second power transmission state, execute the reverse-rotation control on condition that the sheet is supported by the manual tray.

4. The image recording apparatus according to claim 1, further comprising a sensor disposed upstream of the conveyor roller in the conveying direction, the sensor being configured to output a first signal to the controller when the sensor is sensing the sheet and configured to output a second signal to the controller when the sensor is not sensing the sheet, wherein the controller is configured to, when the supply roller is not rotated, when a signal output from the sensor is switched from the second signal to the first signal, and when the switcher is in the first power transmission state, execute the switching control and thereafter execute the reverse-rotation control.

5. The image recording apparatus according to claim 1, further comprising:

a sensor disposed upstream of the conveyor roller in the conveying direction, the sensor being configured to output a first signal to the controller when the sensor is sensing the sheet and configured to output a second signal to the controller when the sensor is not sensing the sheet; and a command output portion configured to output, to the controller, a command for recording an image on the sheet, wherein the controller is configured to, when the command output from the command output portion comprises information indicating that an image is to be recorded on the sheet supported by the manual tray and when the switcher is in the first power transmission state, execute the switching control and thereafter, on condition that the sensor outputs the first signal after the switching control, execute the reverse-rotation control.

6. The image recording apparatus according to claim 5, wherein the controller is configured to, when the command output from the command output portion comprises information indicating that the image is to be recorded on the sheet supported by the supply tray and when the switcher is in the second power transmission state, switch the switcher to the first power transmission state and thereafter execute the reverse-rotation control.

7. The image recording apparatus according to claim 5, wherein the controller is configured to, when the command output from the command output portion comprises information indicating that the image is to be recorded on the sheet supported by the supply tray and when a signal output from the sensor is not switched from the second signal to the first signal by rotation of the supply roller in the first rotational direction, execute the switching control and thereafter execute the reverse-rotation control on condition that support of the sheet by the manual tray has been performed.

8. The image recording apparatus according to claim 5, wherein the controller is configured to, when the command output from the command output portion comprises information indicating that the image is to be recorded on the sheet supported by the supply tray and when the sheet supported by the supply tray is less in size than a sheet on which the image is to be recorded, execute the switching control and thereafter execute the reverse-rotation control on condition that support of the sheet by the manual tray has been performed.

9. The image recording apparatus according to claim 1, wherein the recording device comprises:

a recording head comprising a nozzle face that comprises a plurality of nozzles formed therein, the recording head being configured to eject ink from the plurality of nozzles to form an image on the sheet; and a carriage configured to hold the recording head and reciprocable in main scanning directions perpendicular to the conveying direction, and wherein the switcher comprises a contact portion, and the carriage is contactable with the contact portion to move the switcher selectively to one of (i) a transmission area in which the switcher is in the first power transmission state and (ii) a non-transmission area in which the switcher is in the second power transmission state.

10. The image recording apparatus according to claim 9, wherein the switcher is configured to move between the transmission area and non-transmission area in the main scanning direction by movement of the carriage in the main scanning direction.

11. The image recording apparatus according to claim 9, further comprising:

a cap configured to selectively take one of a capping state in which the cap covers the nozzle face and a separated state in which the cap is spaced apart from the nozzle face, the cap being configured to take the capping state when the switcher is located at a capping position within the non-transmission area; and a cap-state switcher configured to switch a state of the cap from the separated state to the capping state in conjunction with movement of the switcher from the transmission area to the capping position, the cap-state switcher being configured to switch the state of the cap from the capping state to the separated state in conjunction with movement of the switcher from the capping position to the transmission area, wherein the controller is configured to switch the switcher to the second power transmission state by moving the switcher to the capping position.

12. The image recording apparatus according to claim 9, wherein the conveyance driving power transmitter comprises:

a motor pulley mounted on a shaft of the motor;

a conveyance pulley mounted on a shaft of the conveyor roller; and a belt looped over the motor pulley and the conveyance pulley, wherein the supply driving power transmitter comprises:

a conveyance gear mounted on the shaft of the conveyor roller;

a supply gear capable of transmitting the driving power transmitted to the conveyance gear;

a first transmitter coupled to the supply gear;

a sun gear coupled to the supply gear;

a planetary gear capable of revolving in a rotational direction of the sun gear while being meshed with the sun gear; and a second transmitter coupled to the supply roller, wherein, when the motor rotates reversely, the planetary gear is coupled to the second transmitter, and when the motor rotates forwardly, the planetary gear is moved off the second transmitter, wherein the switcher comprises a switch gear meshed with the conveyance gear and configured to be moved selectively to one of the transmission area and the non-transmission area by contact of the carriage with the contact portion, and wherein the switch gear is meshed with the supply gear when the switcher is located at the transmission area, and the switch gear is not meshed with the supply gear when the switcher is located at the non-transmission area.

13. The image recording apparatus according to claim 12, wherein the switch gear is configured to move selectively to one of the transmission area and the non-transmission area in the main scanning direction, wherein the planetary gear is coupled to the second transmitter by the reverse rotation of the motor by a first rotational amount, and wherein the controller is configured to control the motor to alternately rotate forwardly and reversely by a second rotational amount that is less than the first rotational amount, after the switch gear is moved from the non-transmission area to the transmission area.

* * * * *